US007434704B2

(12) United States Patent
Yuyama et al.

(10) Patent No.: US 7,434,704 B2
(45) Date of Patent: Oct. 14, 2008

(54) MEDICINE FEEDER

(75) Inventors: Shoji Yuyama, Osaka (JP); Shinji Yamaguchi, Osaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 259 days.

(21) Appl. No.: 10/523,823

(22) PCT Filed: Aug. 5, 2003

(86) PCT No.: PCT/JP03/09902

§ 371 (c)(1),
(2), (4) Date: Sep. 7, 2005

(87) PCT Pub. No.: WO2004/012647

PCT Pub. Date: Feb. 12, 2004

(65) Prior Publication Data

US 2006/0113314 A1 Jun. 1, 2006

(30) Foreign Application Priority Data

Aug. 5, 2002 (JP) ..... 2002-227071
Oct. 18, 2002 (JP) ..... 2002-305166

(51) Int. Cl.
*G07F 11/16* (2006.01)

(52) U.S. Cl. ..... 221/222; 221/221; 221/277; 221/297

(58) Field of Classification Search ..... 221/1–312 C; 700/231–244
See application file for complete search history.

(56) References Cited

U.S. PATENT DOCUMENTS 4,018,358 A * 4/1977 Johnson et al. ..... 221/7
4,111,332 A * 9/1978 Hurst et al. ..... 221/7
4,674,652 A * 6/1987 Aten et al. ..... 221/3
4,697,721 A * 10/1987 Johnson et al. ..... 221/211
5,337,919 A * 8/1994 Spaulding et al. ..... 221/2
5,431,299 A * 7/1995 Brewer et al. ..... 221/2
5,860,563 A * 1/1999 Guerra et al. ..... 221/172
6,112,502 A 9/2000 Frederick et al.

(Continued)

FOREIGN PATENT DOCUMENTS

JP 62-502870 11/1987

(Continued)

OTHER PUBLICATIONS

Supplementary European Search Report (in English language) issued Aug. 22, 2007 in European Application No. 03 76 6730.

*Primary Examiner*—Gene O. Crawford
*Assistant Examiner*—Michael K Collins
(74) *Attorney, Agent, or Firm*—Wenderoth, Lind & Ponack, L.L.P.

(57) ABSTRACT

A medicine feeder is composed of: a cassette (2) for housing medicines D in an array; a biasing member (6) for biasing the medicines D in the cassette (2) toward one end side; and a discharge member (16) disposed on one end portion of the cassette (2) for holding a medicine D in a holding recess portion (18) and discharging the medicines D one at a time by rotating the discharge member. This makes it possible to ensure the discharge of a prescribed quantity of medicines based on prescription data.

13 Claims, 33 Drawing Sheets

U.S. PATENT DOCUMENTS

| | | | | |
|---|---|---|---|---|
| 6,216,910 | B1 * | 4/2001 | Numerick | 221/7 |
| 6,370,841 | B1 | 4/2002 | Chudy et al. | |
| 6,625,952 | B1 * | 9/2003 | Chudy et al. | 53/168 |
| 7,228,198 | B2 * | 6/2007 | Vollm et al. | 700/235 |
| 7,316,328 | B2 * | 1/2008 | Yuyama et al. | 221/227 |
| 2002/0070226 | A1 | 6/2002 | Liff et al. | |
| 2004/0158350 | A1 * | 8/2004 | Ostergaard et al. | 700/231 |

FOREIGN PATENT DOCUMENTS

| | | |
|---|---|---|
| JP | 2-28406 | 9/1988 |
| JP | 63-228406 | 9/1988 |
| JP | 5-229660 | 9/1993 |
| JP | 7-285674 | 10/1995 |
| JP | 10-83476 | 3/1998 |
| JP | 2000-72204 | 3/2000 |
| JP | 2000-255651 | 9/2000 |
| JP | 3082647 | 12/2001 |
| JP | 2003-79701 | 3/2003 |
| JP | 2003-81429 | 3/2003 |
| WO | 86/06048 | 10/1986 |
| WO | 98/58765 | 12/1998 |

* cited by examiner

Fig. 25

Yr9999Mth99Day99

Time 99:99

Perform fingerprint recognition

Fig. 26

User: XXXXXXXXXX

OK NG

Fig. 27

99/99/99 99:99 Ver 1.00.00

Anticancer drug management menu

| | | |
|---|---|---|
| Discharge operation | Master maintenance | Inquiry operation |
| Replenishing operation | Dairy report | End |

Fig. 28

99/99/99 99:99 Ver 1.00.00

Auto

Manual

Fig. 29

Processed clients list 99/99/99 99:99 Ver 1.00.00

| Seq | Client ID | Client Name | Department | Ward |
|---|---|---|---|---|
| 999999 | XXXXXXXXXX | NNNNNNNNNN | NNNNNNNN | NNNNNNNN |
| 999999 | XXXXXXXXXX | NNNNNNNNNN | NNNNNNNN | NNNNNNNN |
| 999999 | XXXXXXXXXX | NNNNNNNNNN | NNNNNNNN | NNNNNNNN |
| 999999 | XXXXXXXXXX | NNNNNNNNNN | NNNNNNNN | NNNNNNNN |
| 999999 | XXXXXXXXXX | NNNNNNNNNN | NNNNNNNN | NNNNNNNN |
| 999999 | XXXXXXXXXX | NNNNNNNNNN | NNNNNNNN | NNNNNNNN |
| 999999 | XXXXXXXXXX | NNNNNNNNNN | NNNNNNNN | NNNNNNNN |
| 999999 | XXXXXXXXXX | NNNNNNNNNN | NNNNNNNN | NNNNNNNN |
| 999999 | XXXXXXXXXX | NNNNNNNNNN | NNNNNNNN | NNNNNNNN |
| 999999 | XXXXXXXXXX | NNNNNNNNNN | NNNNNNNN | NNNNNNNN |

End

Fig. 30

Automatic discharge operation 99/99/99 99:99 Ver1.00.00

Client ID 9999999999 Issued date 9999/99/99
Furigana name XXXXXXXXXXXXXXXXXXXX Administrated date 9999/99/99
Client name NNNNNNNNNNN Birth date NN 99 year 99 month 99 day 999.99
Ward XXXXX XXXXXXXXX Doctor name XXXXXXX NNNNNNNN
Department XXXXX XXXXXXXXX RpNo 99

| No | Code | Medicine name | Dosage | Unit | Discharged quantity | Note |
|---|---|---|---|---|---|---|
| 99 | XXXXXX | XXXXXXXXXXXXXXXXXXXX | 9999.999 | XXX | 999 | XXXXXX |
| 99 | XXXXXX | XXXXXXXXXXXXXXXXXXXX | 9999.999 | XXX | 999 | XXXXXX |
| 99 | XXXXXX | XXXXXXXXXXXXXXXXXXXX | 9999.999 | XXX | 999 | XXXXXX |
| 99 | XXXXXX | XXXXXXXXXXXXXXXXXXXX | 9999.999 | XXX | 999 | XXXXXX |
| 99 | XXXXXX | XXXXXXXXXXXXXXXXXXXX | 9999.999 | XXX | 999 | XXXXXX |

Discharge | Delete line | Add line | Cancel | End

Fig. 31

99/99/99 99:99 Ver 1.00.00

Inquiry operation menu

| | | |
|---|---|---|
| Prescription history inquiry | Medicine administration search | Medicine usage |
| Medicine usage per doctor | Medicine usage per ward | Medicine usage per controlled medicine |
| | | |
| | | End |

Fig. 32

Prescription history inquiry 99/99/99 99:99 Ver1.00.00

Client ID 9999999999
Furigana name XXXXXXXXXXXXXXXXXXXX
Client name X X X X X X X X X X
Ward X X X X X X X X X X
Department X X X X X X X X X X Issued date 9999/99/99
Administrated date 9999/99/99
Birth date NN 99 year 99 month 99 day 999.99
Doctor name X X X X X X X X X X
RpNo 99

| No | Medicine name | Dosage Unit | Discharged quantity | Note |
|---|---|---|---|---|
| 99 | XXXXXXXXXXXXXXXXXXXX | 9999.999XXX | 999XXX | NNNNNNNNNN |
| 99 | XXXXXXXXXXXXXXXXXXXX | 9999.999XXX | 999XXX | NNNNNNNNNN |
| 99 | XXXXXXXXXXXXXXXXXXXX | 9999.999XXX | 999XXX | NNNNNNNNNN |
| 99 | XXXXXXXXXXXXXXXXXXXX | 9999.999XXX | 999XXX | NNNNNNNNNN |
| 99 | XXXXXXXXXXXXXXXXXXXX | 9999.999XXX | 999XXX | NNNNNNNNNN |

Delete Cancel Print End

Fig. 33

Medicine administration search 99/99/99 99:99 Ver1.00.00

Administrated date 9999/99/99
Medicine code XXXXXX X X X X X X X X X X X X X X X X X X X X X X

| No | Client ID | Client name | Dosage Unit | Discharged quantity | Ward name |
|---|---|---|---|---|---|
| 999 | 9999999999 | XXXXXXXXXX | 9999.99XXX | 999XXX | XXXXXXXXX |
| 999 | 9999999999 | XXXXXXXXXX | 9999.99XXX | 999XXX | XXXXXXXXX |
| 999 | 9999999999 | XXXXXXXXXX | 9999.99XXX | 999XXX | XXXXXXXXX |
| 999 | 9999999999 | XXXXXXXXXX | 9999.99XXX | 999XXX | XXXXXXXXX |
| 999 | 9999999999 | XXXXXXXXXX | 9999.99XXX | 999XXX | XXXXXXXXX |
| 999 | 9999999999 | XXXXXXXXXX | 9999.99XXX | 999XXX | XXXXXXXXX |

Execute Delete Print End

Fig. 34

Medicine usage 99/99/99 99:99 Ver1.00.00

Administrated date 9999/99/99 ~ 9999/99/99 Ascending order Descending order

| No | Medicine code | Medicine name | Usage | Unit | Discharged quantity |
|---|---|---|---|---|---|
| 999 | XXXXXX | XXXXXXXXXXXXXXXXXXXX | 999999.9999 | XXX | 9999999 |
| 999 | XXXXXX | XXXXXXXXXXXXXXXXXXXX | 999999.9999 | XXX | 9999999 |
| 999 | XXXXXX | XXXXXXXXXXXXXXXXXXXX | 999999.9999 | XXX | 9999999 |
| 999 | XXXXXX | XXXXXXXXXXXXXXXXXXXX | 999999.9999 | XXX | 9999999 |
| 999 | XXXXXX | XXXXXXXXXXXXXXXXXXXX | 999999.9999 | XXX | 9999999 |
| 999 | XXXXXX | XXXXXXXXXXXXXXXXXXXX | 999999.9999 | XXX | 9999999 |

Execute Cancel Print End

Fig. 35

Replenishing operation 99/99/99 99:99 Ver1.00.00

Operator NNNNNNNNNN

| No | JAN code | Medicine name | Replenished quantity | Before replenish | After replenish |
|---|---|---|---|---|---|
| 999 | 9999999999999 | XXXXXXXXXXXXXXXXXXXX | 999 | 999 | 999 |
| 999 | 9999999999999 | XXXXXXXXXXXXXXXXXXXX | 999 | 999 | 999 |
| 999 | 9999999999999 | XXXXXXXXXXXXXXXXXXXX | 999 | 999 | 999 |
| 999 | 9999999999999 | XXXXXXXXXXXXXXXXXXXX | 999 | 999 | 999 |
| 999 | 9999999999999 | XXXXXXXXXXXXXXXXXXXX | 999 | 999 | 999 |
| 999 | 9999999999999 | XXXXXXXXXXXXXXXXXXXX | 999 | 999 | 999 |

Replenish Cancel Print End

Fig. 36

Medicine usage per doctor 99/99/99 99:99 Ver1.00.00

Administrated date 9999/99/99 ~ 9999/99/99
Doctor code XXXXXXXXX NNNNNNNNNN

| No | Medicine name | Usage | Unit | Doctor name |
|---|---|---|---|---|
| 999 | XXXXXXXXXXXXXXXXXXXX | 999999.9999 | XXX | NNNNNNNNNN |
| 999 | XXXXXXXXXXXXXXXXXXXX | 999999.9999 | XXX | NNNNNNNNNN |
| 999 | XXXXXXXXXXXXXXXXXXXX | 999999.9999 | XXX | NNNNNNNNNN |
| 999 | XXXXXXXXXXXXXXXXXXXX | 999999.9999 | XXX | NNNNNNNNNN |
| 999 | XXXXXXXXXXXXXXXXXXXX | 999999.9999 | XXX | NNNNNNNNNN |
| 999 | XXXXXXXXXXXXXXXXXXXX | 999999.9999 | XXX | NNNNNNNNNN |

Execute Cancel Print End

Fig. 37

Medicine usage per ward 99/99/99 99:99 Ver1.00.00

Administrated date 9999/99/99 ~ 9999/99/99 Ascending order Descending order
Ward code XXXXX NNNNNNNNNN

| No | Medicine name | Usage | Unit | Ward name |
|---|---|---|---|---|
| 999 | XXXXXXXXXXXXXXXXXXXX | 999999.9999 | XXX | NNNNNNNNNN |
| 999 | XXXXXXXXXXXXXXXXXXXX | 999999.9999 | XXX | NNNNNNNNNN |
| 999 | XXXXXXXXXXXXXXXXXXXX | 999999.9999 | XXX | NNNNNNNNNN |
| 999 | XXXXXXXXXXXXXXXXXXXX | 999999.9999 | XXX | NNNNNNNNNN |
| 999 | XXXXXXXXXXXXXXXXXXXX | 999999.9999 | XXX | NNNNNNNNNN |
| 999 | XXXXXXXXXXXXXXXXXXXX | 999999.9999 | XXX | NNNNNNNNNN |

Execute Cancel Print End

Fig. 38

Medicine usage per controlled medicine 99/99/99 99:99 Ver1.00.00

Administrated date 9999/99/99 ~ 9999/99/99 Ascending order Descending order

Classification XX NNNNNNNNNNNNNNN

| No | Medicine name | Usage | Unit |
|---|---|---|---|
| 9999 | XXXXXXXXXXXXXXXXXXXX | 999999.9999 | XXX |
| 9999 | XXXXXXXXXXXXXXXXXXXX | 999999.9999 | XXX |
| 9999 | XXXXXXXXXXXXXXXXXXXX | 999999.9999 | XXX |
| 9999 | XXXXXXXXXXXXXXXXXXXX | 999999.9999 | XXX |
| 9999 | XXXXXXXXXXXXXXXXXXXX | 999999.9999 | XXX |
| 9999 | XXXXXXXXXXXXXXXXXXXX | 999999.9999 | XXX |

Execute Cancel Print End

Fig. 39

99/99/99 99:99 Ver 1.00.00

Master maintenance

| | | |
|---|---|---|
| Client master | Medicine master | Master read |
| Department master | Unit master | |
| Ward master | Title master | |
| User master | Error message | End |

Fig. 40

Medicine master 99/99/99 99:99 Ver1.00.00

Medicine code XXXXXX NNNNNNNNNNNNNNNNNNNN Host code XXXXXXXXXX

Abbreviated name NNNNNNNNN Ministry of Health and Welfare code XXXXXXXXXXXX

JAN code 9999999999999

| Medicine unit | | | | | | | |
|---|---|---|---|---|---|---|---|
| 1 | XXXXX | NNN | | | One dose | 999999.9999 | NNN |
| 2 | XXXXX | NNN | X | 999999.999 | Daily dose | 999999.9999 | NNN |
| 3 | XXXXX | NNN | X | 999999.999 | Maximum dose | 999999.9999 | NNN |

| Expiration date | 99/99/99 | Controlled | Narcotic | Poisonous | Psychotropic | Anti-cancer | X X | X X | X X | X X | X X |
|---|---|---|---|---|---|---|---|---|---|---|---|
| | | 9 | 9 | 9 | 9 | 9 | 9 | 9 | 9 | 9 | 9 |

| Unit No | Shelf No | | | | |
|---|---|---|---|---|---|
| 1 | 999 | 999 | 999 | 999 | 999 |
| 2 | 999 | 999 | 999 | 999 | 999 |
| 3 | 999 | 999 | 999 | 999 | 999 |

Reference inventory quantity 99999

Appropriate inventory quantity 99999

Shelf No XXXXX Consumed quantity 999999999

Register Delete Cancel Print End

Fig. 41

99/99/99 99:99 Ver 1.00.00

Daily report menu

| | | |
|---|---|---|
| Daily report on discharge | Daily report on replenishment | |
| | | |
| | | |
| | | End |

Fig. 42

Daily report on replenishment 99/99/99 99:99 Ver 1.00.00

Output target date 99/99/99 ~ 99/99/99

Execute

End

MEDICINE FEEDER

BACKGROUND OF THE INVENTION

1. Technical Field

The present invention relates to a medicine feeder which allows discharge of medicines singly.

2. Description of Related Art

Medicines are conventionally housed in cassettes which are contained in a stock shelf in such a way that the cassettes can be pulled out. According to need, the cassettes are pulled out from the stock shelf to discharge appropriate medicines.

However, in the case of using the stock shelf, the location of the cassettes contained therein may affect access to the medicines housed in the cassettes since the medicines should be taken and held from an upper aperture of the pulled-out cassettes. Further, as a quantity of medicines housed in the cassettes is increased, not only the cassettes themselves are hard to pulled out, but also medicines housed on the back side of the cassettes are difficult remove. Further, in the case of a medicine such as anticancer drugs whose administration is strictly restricted, it is not desirable to allow free access to the medicine. However, adopting the structure featuring such solution as locking will deteriorate workability and also require an additional operation to confirm that the medicines are securely locked up.

Accordingly, it is a primary object of the present invention to provide a medicine feeder which makes it possible to ensure discharge of a prescribed quantity of medicines based on prescription data.

SUMMARY OF THE INVENTION

According to the present invention, as a means to solve the problem stated above, there is provided a medicine feeder comprising: a cassette for housing medicines in array; biasing member for biasing the medicines in the cassette toward one end side; and a discharge member disposed on one end portion of the cassette so as to be rotatable between a reception position and an extraction position, wherein the discharge member has: a holding recess portion for holding only one medicine biased by the biasing member upon rotation to the reception position and for maintaining a holding state of the held medicine so that the medicine can be extracted from outside upon rotation to the extraction position; and a support face formed on an opposite side of the holding recess portion so as to be able to support a next medicine when the discharge member rotates to the extraction position.

This structure makes it possible to ensure discharge of the medicines constantly at the same extraction position with minimum necessary operation. Also, in the state that the holding recess portion of the discharge member is rotated to the extraction position, confirmation of the medicine can be performed. In addition, in the case of returning the medicine to the cassette, it can be achieved only by rotating the discharge member so that the holing recess portion moves to the reception position. In this case, the support face formed on the opposite side of the holding recess portion supports the next medicine, so that the medicine held in the holding recess portion is returned to the cassette smoothly. This makes it possible to enhance workability in the operation for extracting and housing the medicines.

It is desirable to include: medicine detection member for detecting whether or not a medicine is present in the holding recess portion when the discharge member is positioned at the extraction position; and control device for allowing driving of the discharge member based on prescription data and a detection signal in the medicine detection member, which allows automatic discharge of a desired quantity of medicines.

It is desirable to include a lock member for disabling the discharge member from rotating, wherein the control device controls the lock member so as to lock the discharge member at the reception position when discharge of a prescribed quantity of medicines based on prescription data is completed, which makes it possible to ensure automatic prevention of unauthorized discharge of medicines without manual assistance.

It is desirable that the discharge member has a notch on opposite walls constituting the holding recess portion to facilitate holding of the medicine, which allows easier operation of medicine discharge.

It is to be noted that the biasing means should preferably be structured to be able to apply a fixed load regardless of a quantity of medicines housed in the cassette, which allows more smooth operation of medicine discharge.

It is also possible to provide a medicine quantity detection means for detecting a quantity of medicines in the cassette, the medicine quantity detection means having: a sensor for detecting a biased position by the biasing means in an initial state where medicines are not housed in the cassette; and an encoder for detecting change in the biased position of medicines by the biasing means caused by housing the medicines in the cassettes from the initial state detected by the sensor.

The discharge means may comprise a rotor, and an outer circumferential face of the rotor for supporting a next medicine may be formed so as not to chance a position of the next medicine through rotating movement.

The discharge means may comprise a rotor, and the control means may automatically return the rotor to a standby position if a specified time is passed while the rotor is positioned at the discharge position.

The cassette may be disposed so that housed medicines are arrayed in horizontal direction so as to be discharged one by one in sequence from one end side by the discharge means.

The cassette may be disposed so that housed medicines are arrayed in vertical direction so as to be discharged one by one in sequence from an upper end by the discharge means.

The cassette may be disposed so that vials containing medicines with an upper aperture closed by a lid are housed in a state of being arrayed in horizontal direction in a standing position.

The discharge means may comprise a rotor, and the cassette is structured to be mounted on and dismounted from each housing portion of a stock shelf and has a lock member for preventing the rotor from rotating when the cassette is dismounted from the housing portion.

BRIEF DESCRIPTION OF THE DRAWINGS

FIG. 25 is a view showing a finger print recognition screen.

FIG. 26 is a view showing an OK/NG selection screen;

FIG. 27 is a view showing a various operations screen;

FIG. 28 is a view showing an auto/manual screen;

FIG. 29 is a view showing a processed clients list screen;

FIG. 30 is a view showing a discharge operation screen;

FIG. 31 is a view showing an inquiry operation menu screen;

FIG. 32 is a view showing a prescription history inquiry screen;

FIG. 33 is a view showing a medicine administration search screen;

FIG. 34 is a view showing a medicine usage screen;

FIG. 35 is a view showing a replenishing operation screen;

FIG. 36 is a view showing a medicine usage per doctor screen;

FIG. 37 is a view showing a medicine usage per ward screen;

FIG. 38 is a view showing a medicine usage per controlled medicine screen;

FIG. 39 is a view showing a master maintenance screen;

FIG. 40 is a view showing a medicine master screen;

FIG. 41 is a view showing a daily report menu screen;

FIG. 42 is a view showing a daily report on replenishment screen;

DETAILED DESCRIPTION OF THE INVENTION

Embodiments of the invention will hereinafter be described with reference to the accompanying drawings.

Figure 1:
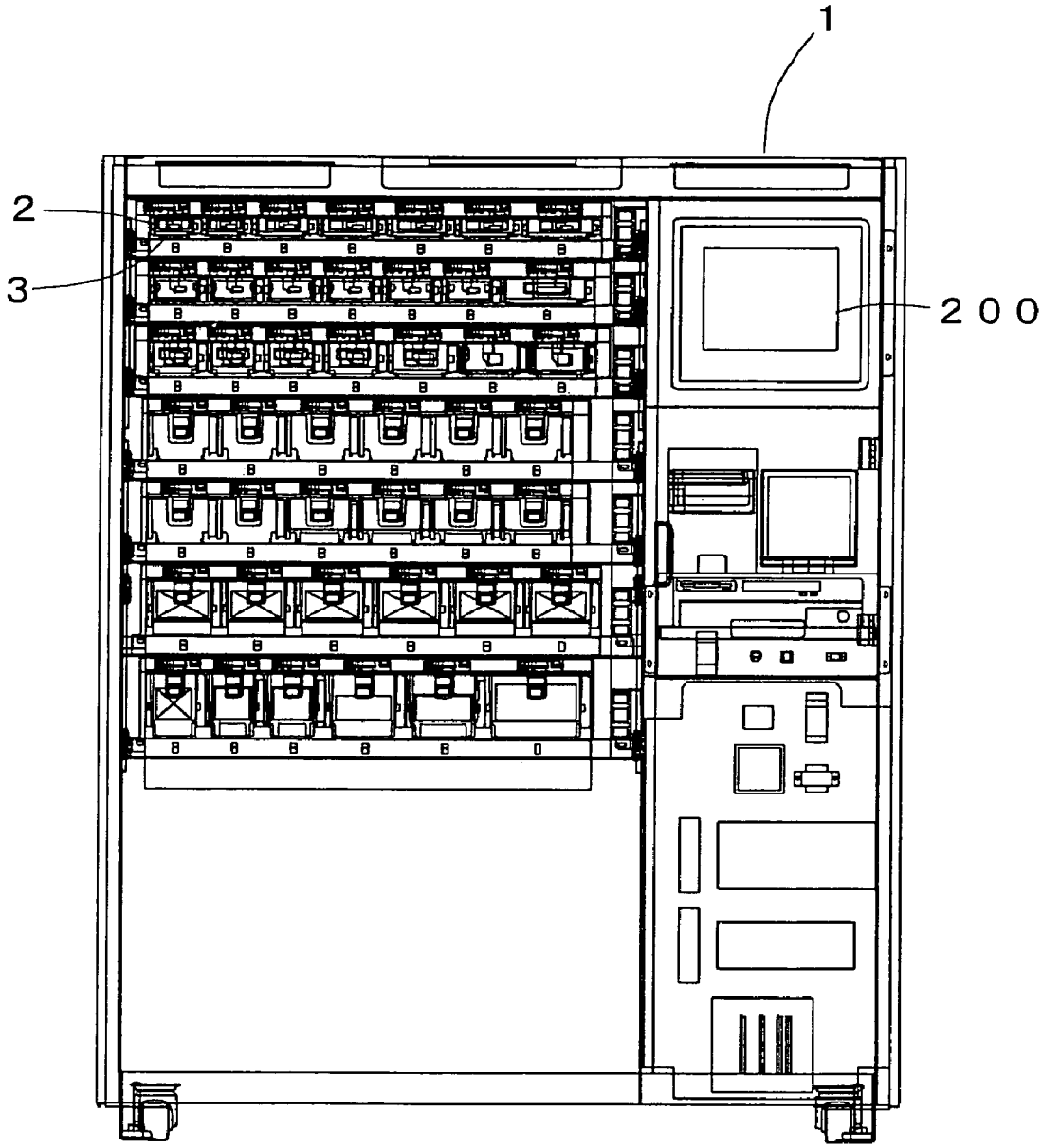
FIG. 1 is a schematic front view showing a medicine feeder in the present embodiment.

FIG. 1 shows a medicine feeder in the present embodiment. In the medicine feeder, a plurality of cassettes 2 are housed in a stock shelf 1 in matrix state. It is to be noted that an operation display panel 200 is provided on the front face of the stock shelf 1 to allow predetermined input and display.

Figure 7:
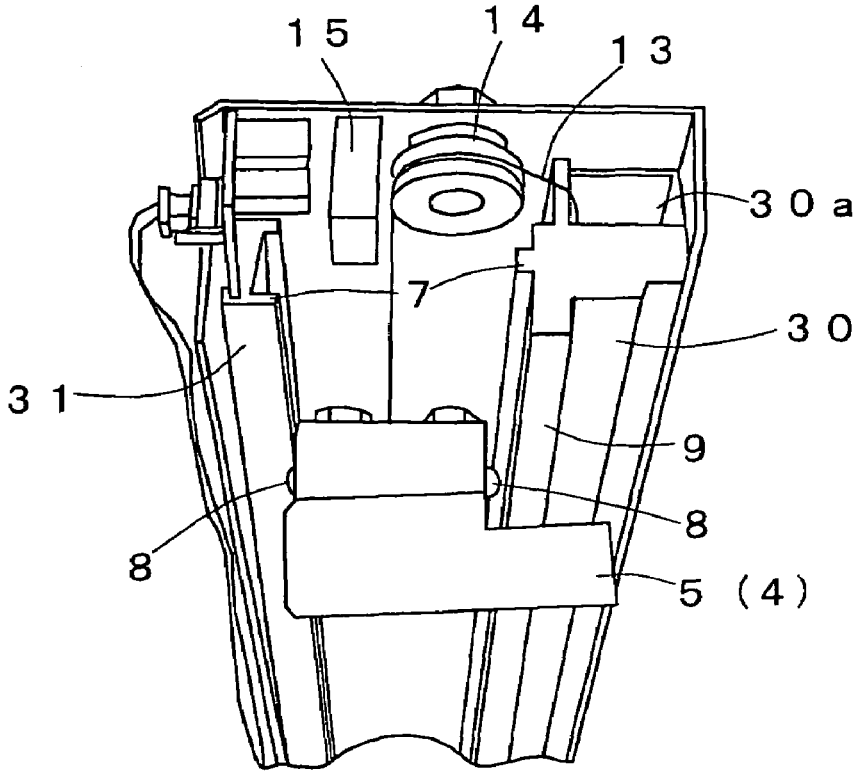
FIG. 7 is a perspective view showing a part of the front side of a housing portion shown in FIG. 1.
Figure 8:
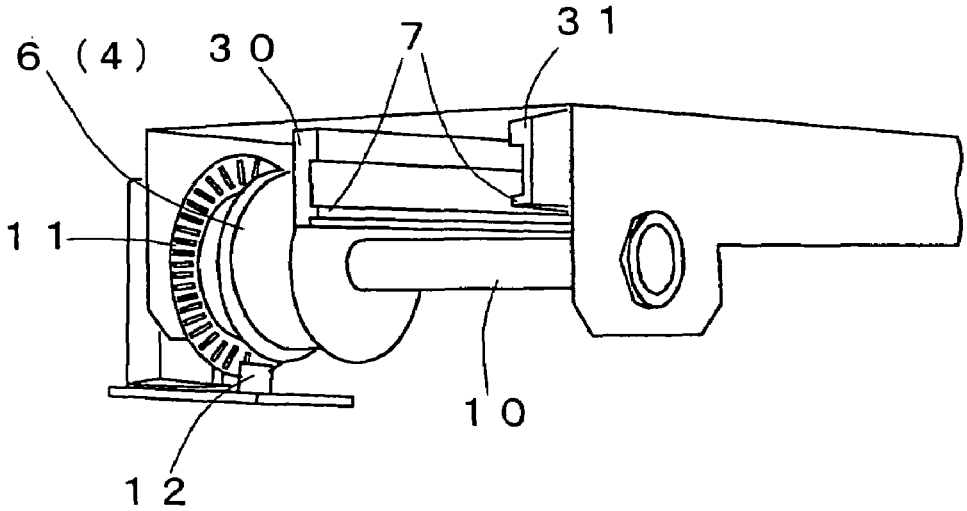
FIG. 8 is a perspective view showing a part of the back side of the housing portion shown in FIG. 1.

The stock shelf 1 includes a plurality of housing portions 3 with the cassettes 2 dismountable or removable therefrom. On the bottom face constituting each housing portion 3, there is parallely provided a pair of guide rails (unshown) for guiding the cassette 2 along the detachment direction. Moreover, on the upper face side constituting each housing portion 3, as shown in FIG. 7 and FIG. 8, there is provided a biasing member 4 for sending a medicine D housed in the cassette 2 toward the front side of the stock shelf 1. The biasing member 4 is composed of a plate-like slide member 5 moving along guide members 30, 31 provided on facing surfaces, and a constant-load spring 6 for biasing the slide member 5 toward the front side of the stock shelf 1. On the facing surfaces of the guide members 30, 31, there is formed a protrusion line 7 extending along a longitudinal direction, and a bearing 8 of the slide member 5 rolls on the upper and lower faces of the protrusion line 7. On the lower face of one guide member 30, there is formed a cassette pressing portion 9 extending along a longitudinal direction, which presses a later-described lid body 17 for preventing the medicine D from floating up when the cassette 2 is mounted on the housing portion 3. The constant-load spring 6 is integrated with a rotary shaft 10 rotatably provided on the back side of the stock shelf 1 and with an encoder 11. The encoder 11 is in a disc shape, and a plurality of slits are formed on an outer circumferential portion along a circumferential direction with prescribed pitches.

Each slit is detected by a remaining quantity sensor 12 and a rotating position is counted so that a quantity of the medicines D in the cassette 2 mounted on the housing portion 3 can be detected. A spring portion of the constant-load spring 6 is connected to a wire 13. The wire 13 is extended to the front side of the stock shelf 1 through a rectangular hole 30*a* formed on one guide member 30, and is connected to the slide member 5 through a roller 14. Consequently, regardless of movement destination positions, the slide member 5 is constantly biased toward the front side of the stock shelf 1 with a certain force. In the vicinity of the roller 14, an origin reset sensor 15 is placed. Without the cassette 2 mounted on the housing portion 3, the slide member 5 is positioned on the front side of the stock shelf 1 through the wire 13 by virtue of the constant-load spring 6. The origin reset sensor 15 is used to detect the slide member 5 moved to the front side while the cassette 2 is not yet mounted and to reset the count by the encoder 11. More particularly, the size of one medicine occupying the longitudinal direction of the cassette 2 (diameter in ampul and width size in medicine box) and an output pulse value from the encoder 11 are associated in advance and stored. Then, when the cassette 2 is mounted, a quantity of the medicines D is calculated based on the output pulse generated when the slide member 5 is pushed by the housed medicine D and moved to the back side. In the case of discharging the medicine D, a remaining quantity of the medicines D is calculated by subtracting a detected output pulse value of the encoder 11 from an output pulse value stored when the cassette 2 is mounted.

Figure 2:
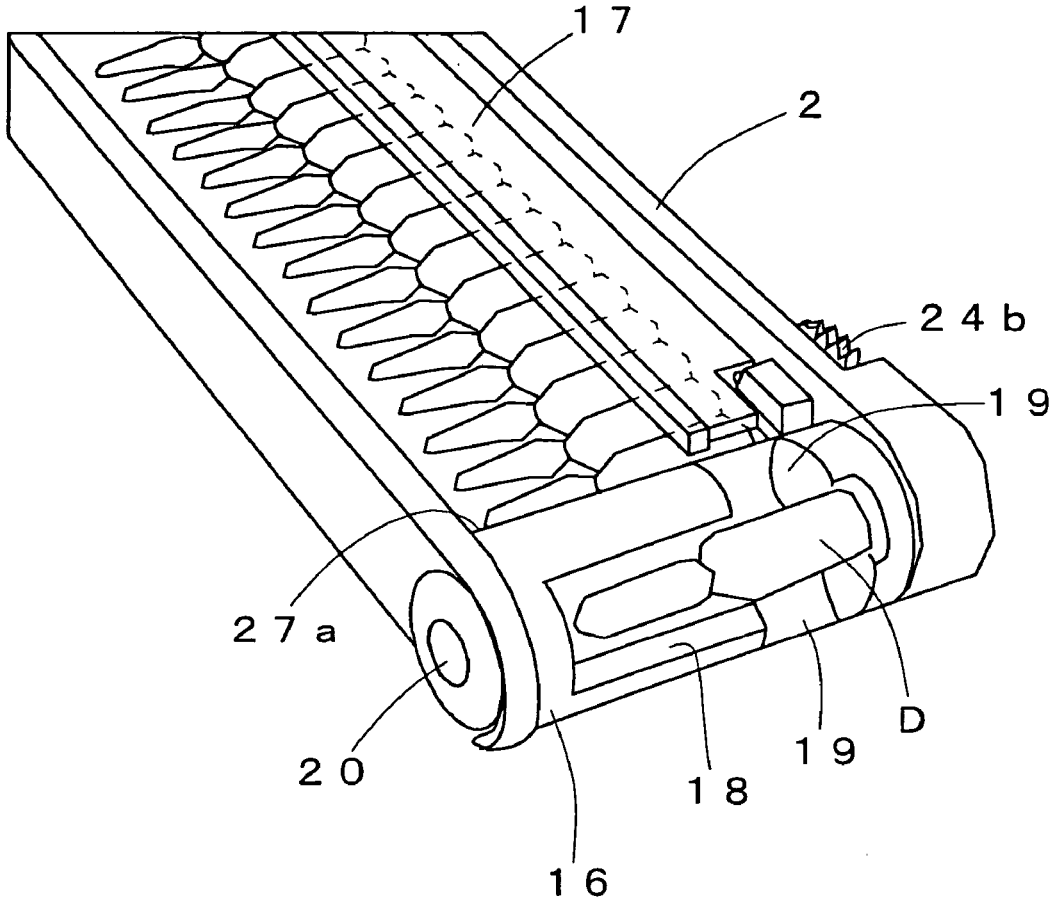
FIG. 2 is a fragmentary perspective view showing one example of a cassette of FIG. 1.

As shown in FIG. 2, each of the cassettes 2 is in a groove shape open to the upper side, and a rotor 16 serving as the discharge member is provided on one end portion so that the medicines D can be discharged singly. Further, in the cassette 2, a lid body 17 which covers a part of the cassette 2 along the upper aperture edge portion is rotatably provided in the state of being biased toward the closed direction. In the cassette 2, the medicines D are housed in an arrayed state, and a part of the housed medicines D is pressed by the cassette pressing portion 9 (see FIG. 7). Further, an a coupling recess portion (not shown) is formed on the bottom face of the cassette 2, and a hook (not shown) provided on the side of the stock shelf 1 is coupled therewith so that when the cassette 2 is mounted, clicking sensation is provided. Further, a recess portion 2*a* (not shown in FIG. 2) is formed on the front side of the cassette 2, that is the side wall on which the rotor 16 is provided, so that when the cassette 2 is pulled out from the stock shelf 1, the cassette 2 is easy to grasp with the fingers.

Figure 3A:
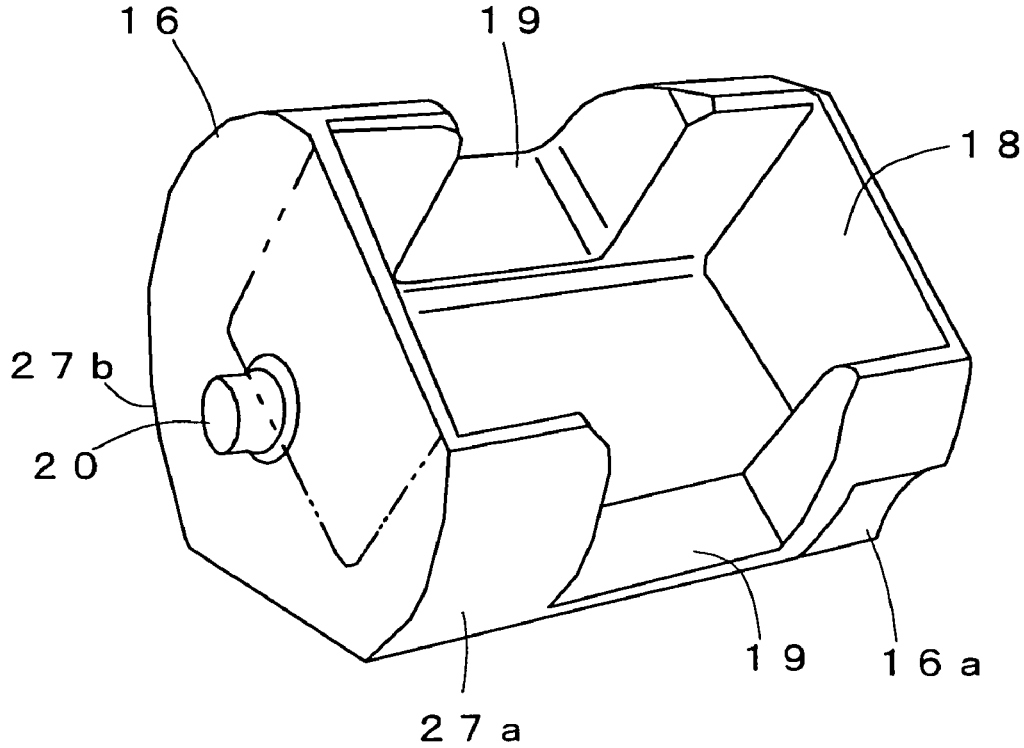
FIG. 3A is a perspective view showing a rotor adoptable for the cassette of FIG. 1.
Figure 3B:
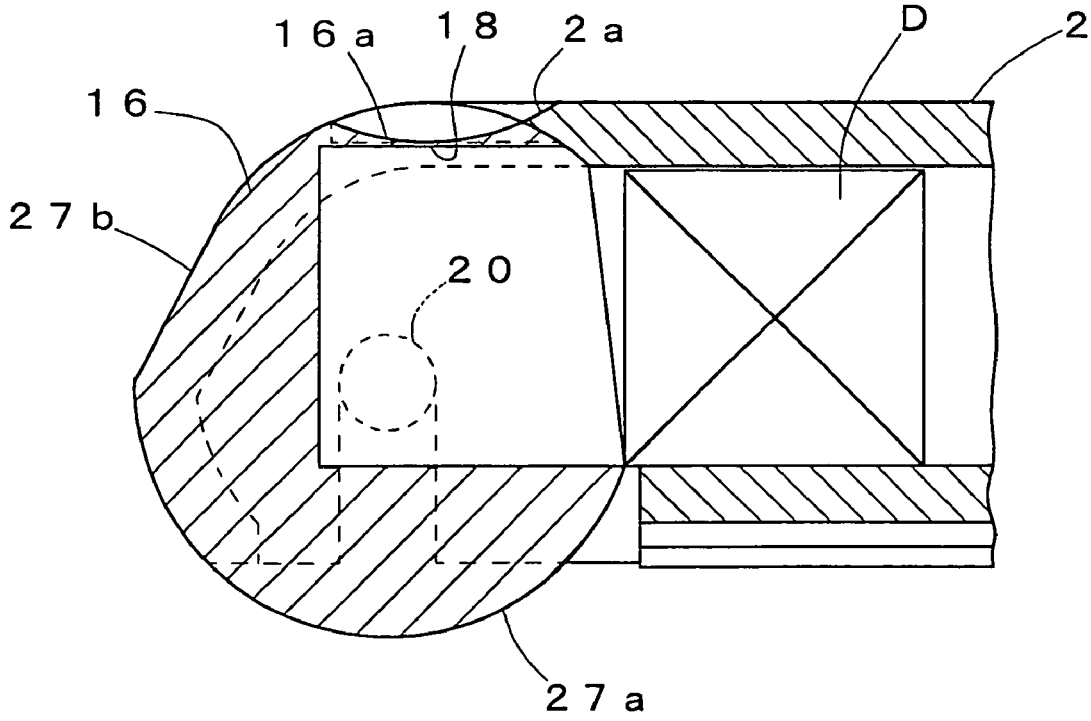
FIG. 3B is a cross sectional view showing the rotor adoptable for the cassette of FIG. 1.

The rotor 16 includes a small-size rotor for discharging ampules and the like as shown in FIG. 2 and a large-size rotor for discharging boxes housing vials and the like as shown in FIGS. 3A and 3B. As shown in FIG. 3, the rotor 16 has a holding recess portion 18 for holding the medicine D. A notch 19 is formed on both side faces constituting the holding recess portion 18 for assisting easy discharge of the medicine D. At least on the right end-side outer circumferential portion of the rotor 16 (or the left end-side outer circumferential portion), there is formed a recess portion 16*a* which is connected to the recess portion 2*a* formed on the cassette 2 at a holding position. The recess portion 16*a* is provided if the cassette 2 is small and so the recess portion 2*a* is not enough for assisting gripping with the fingers. On the central portion on the end face of the rotor 16, a shaft portion 20 protrudes and is rotatably supported by the cassette 2. As shown in FIG. 4, a first gear 21 is integrated with the shaft portion 20, and is engaged with a second gear 22 provided on the cassette 2. An end portion of a long plate-like first link 23 is rotatably linked to an outer circumferential portion of the second gear 22.

On the other end portion of the first link 23, there is formed a protrusion 23*a* which can be pressed by one end portion of an almost V-shaped second link 24 which is rotatably provided on the cassette 2 about a spindle 24*a*. Moreover, in the vicinity of the protrusion 23*a*, a coupling notch portion 23*b* is formed. With the coupling notch portion 23*b*, a coupling piece (not shown) rotatably provided on the cassette 2 is coupled. The coupling piece, which is rotated in forward and backward direction by driving of a motor (not shown), disables the first link 23 from moving while it is coupled with the coupling notch portion 23*b* so as to maintain the rotor 16 in a locked state.

The second link 24 is driven so as to have backward and forward rotation based on the driving force of a stepping motor 25 transmitted via a gear 25*a*. A magnet (not shown) is disposed on the spindle 24*a* at three locations and each magnet is detected by a sensor 26 so that the second link 24 (see FIG. 4A) can be stopped at a standby position (see FIG. 4A), an operating position (see FIG. 5), and a locked position (see FIG. 6), respectively. In the case where the second link 24 is positioned at the standby position, the rotor 16 is positioned, through the first link 23, the second gear 22 and the first gear 21, at a holding position for holding the medicine D in the cassette 2 in the holding recess portion 18 as shown by a dotted line in FIG. 4B. At this point, the recess portion 2*a* formed on the cassette 2 and the recess portion 16*a* formed on the rotor 16 are positioned to be continued, so that by getting the fingers caught in this continued portion, the cassette 2 can be pulled out from the stock shelf 1. When the second link 24 is rotated to the operating position shown in FIG. 5, the rotor 16 rotates, through the first link 23, the second gear 22 and the first gear 21, to an extraction position shown by a center line in FIG. 5, so that the medicine D held in the holding recess portion 18 can be extracted. When the second link 24 is rotated to the locked position shown in FIG. 6, the rotor 16 is disabled from rotating. Whether the medicine D is held in the holding recess portion 18 when the rotor 16 is rotated to the extraction position is detected by a medicine detection sensor (not shown).

On the outer face of the rotor 16, as shown in FIGS. 3A and 3B, there are formed a support face 27*a* for supporting the next medicine D when the rotor 16 rotates while holding the medicine D in the holding recess portion 18, and a planar face 27*b* for sticking a label on which a medicine name is printed.

The outer shape of the rotor 16 is determined as follows. First, a column having a holding recess portion 18 large enough to be able to house a medicine D is assumed, with the center of its axis being aligned to the central position of the medicine D. Then, on the end face of the rotor 16, a shaft portion 20 is provided in a protruding manner so as to be positioned on the lower side of the center of the axis of the column and on its one end side (front side of the stock shelf 1). Then, a support face 27*a* is formed on a circle around the shaft portion 20. Further, a planar face 27*b* connected to the support face 27*a* is formed in a position which allows easy visual inspection from the front side when the rotor 16 is positioned at the holding position.

Figure 16A:
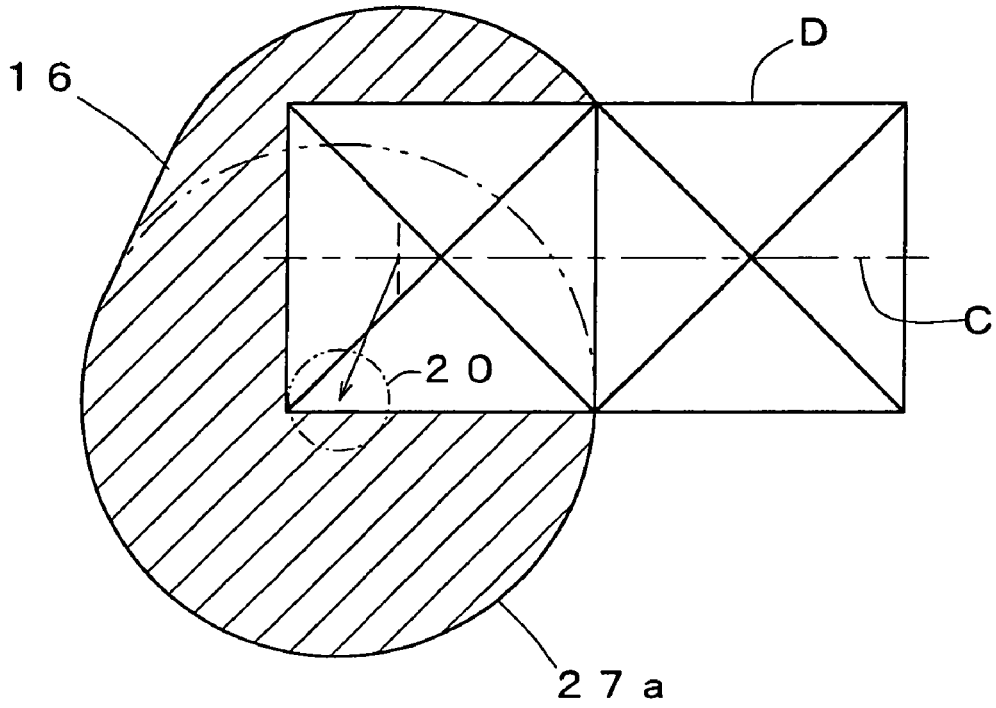
FIG. 16A and FIG. 16B are schematic views showing comparison of movement tracks of support faces each having a shaft portion of the rotor placed in a position different from each other.
Figure 16B:
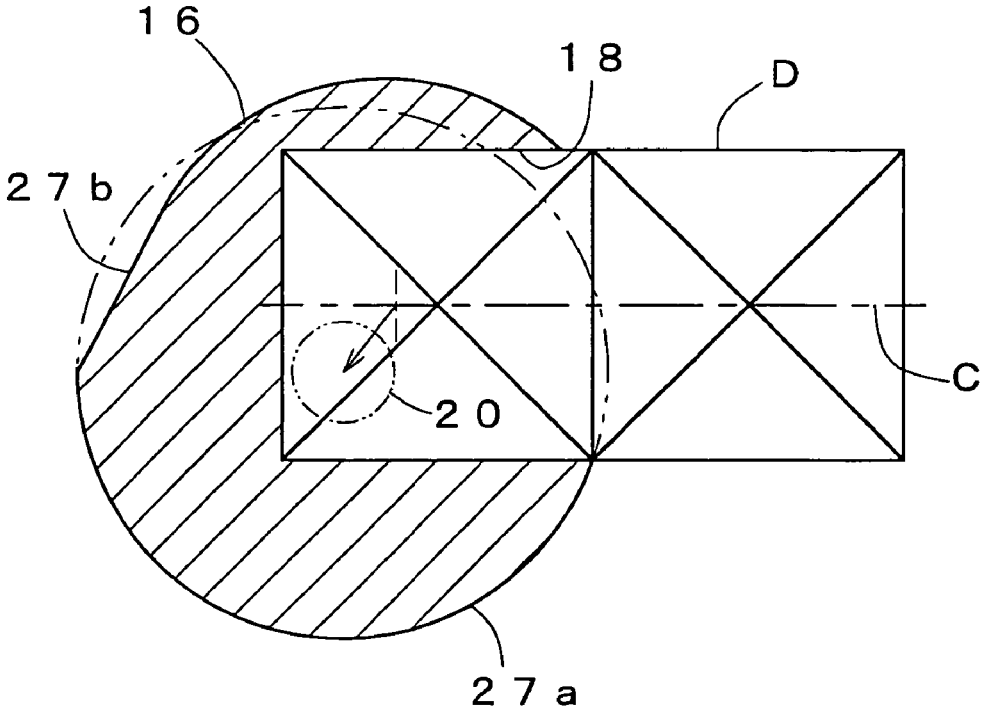
Figure 17A:
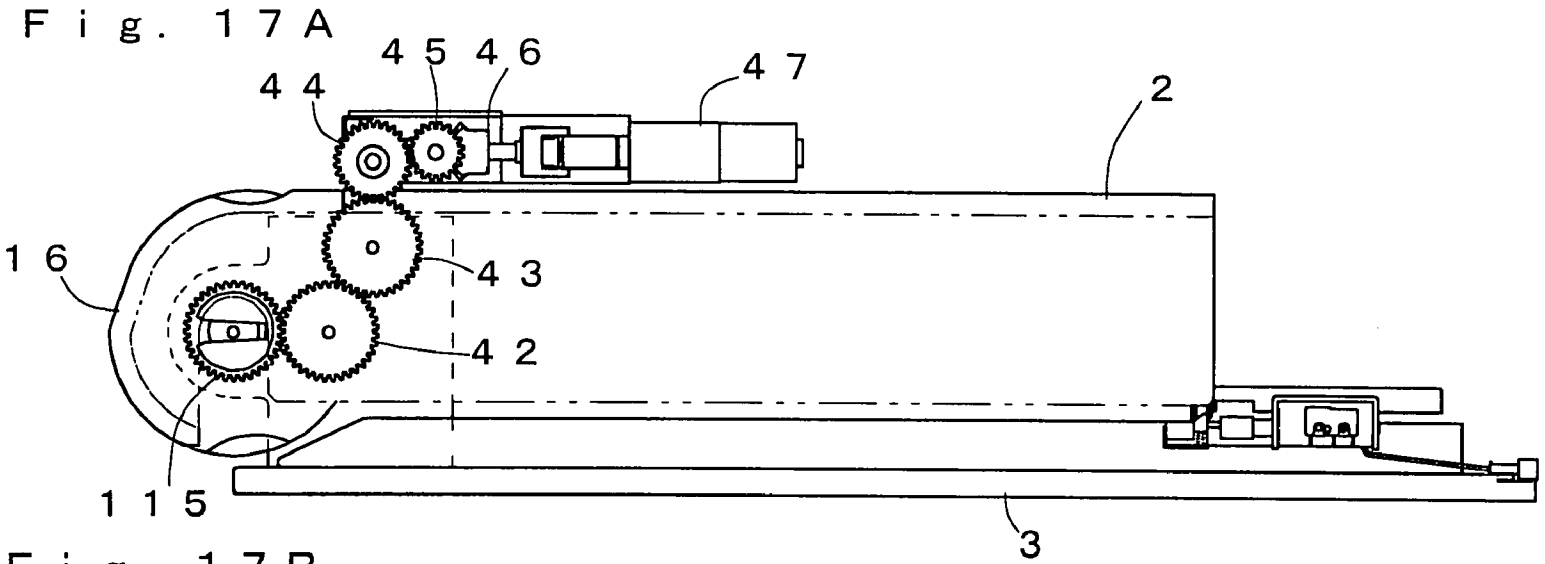
FIG. 17A is a side view showing the side of a gear of the rotational driving mechanism of the rotor in still another embodiment after a cassette is mounted on a housing portion.
Figure 17B:
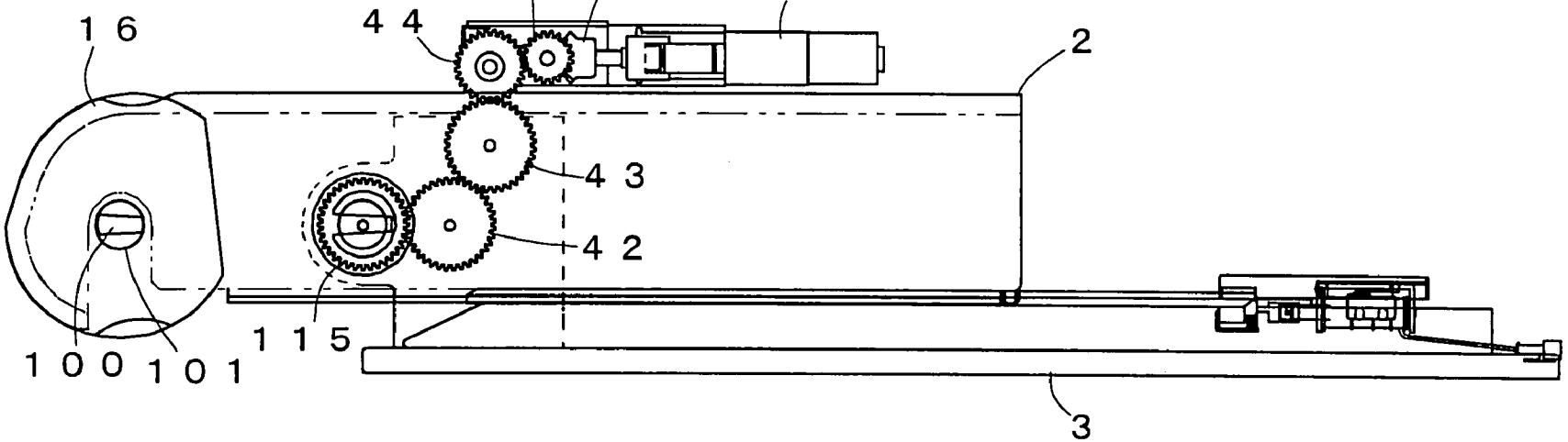
FIG. 17B is a side view showing the rotational driving mechanism of the rotor in the another embodiment before the cassette is mounted on the housing portion.

In the meantime, in order to prevent the track of the support face 27*a* when the rotor 16 is rotated from moving in forward and backward directions with respect to the next medicine D, the shaft portion 20 should preferably be positioned on the side as low as possible. As shown in FIG. 16A, if the shaft portion 20 is on the same plane as the lowermost portion of the medicine D, that is the bottom face of the cassette 2, then the next medicine D will not move forward and backward even when the rotor 16 rotates. However, if the shaft portion 20 is positioned on the lower side, in view of occupied space of the rotor 16, it is difficult to increase the scale of integration of the cassettes 2 which are disposed so as to be vertically stacked. Accordingly, in this embodiment, the shaft portion 20 is structured such that downward displacement with respect to a center C of the medicine D is suppressed and displacement toward the front side is increased.

Consequently, while the occupied space of the rotor 16 in the vertical direction of the cassette 2 is suppressed, the track of the support face 27*a* which is generated when the rotor 16 rotates from the holding position to the discharge position (in the case where the medicine D is held in the holding recess portion 18 so as to slightly protrude from the holding recess portion 18 in consideration of interference between the rotor 16 and the next medicine D, the track of a corner portion of the medicine D held in the holding recess portion 18) is kept almost unchanged with respect to the array direction of the medicines D housed in the cassette 2, which allows suppression of dislocation of the next medicine D.

It is to be noted that when the rotor 16 rotates, friction force between the support face 27*a* and the next medicine D acts as force to lift the next medicine D, though the lid body 17 prevents the medicine D from floating up. Further, the shaft portion 20 of the rotor 16 should be provided so as to be displaced toward the support face 27*a*. For example, if the discharge direction of the medicines D is changed from the above-stated counterclockwise direction to clockwise direction, the shaft portion 20 should be displaced toward the upper front side.

Figure 9:
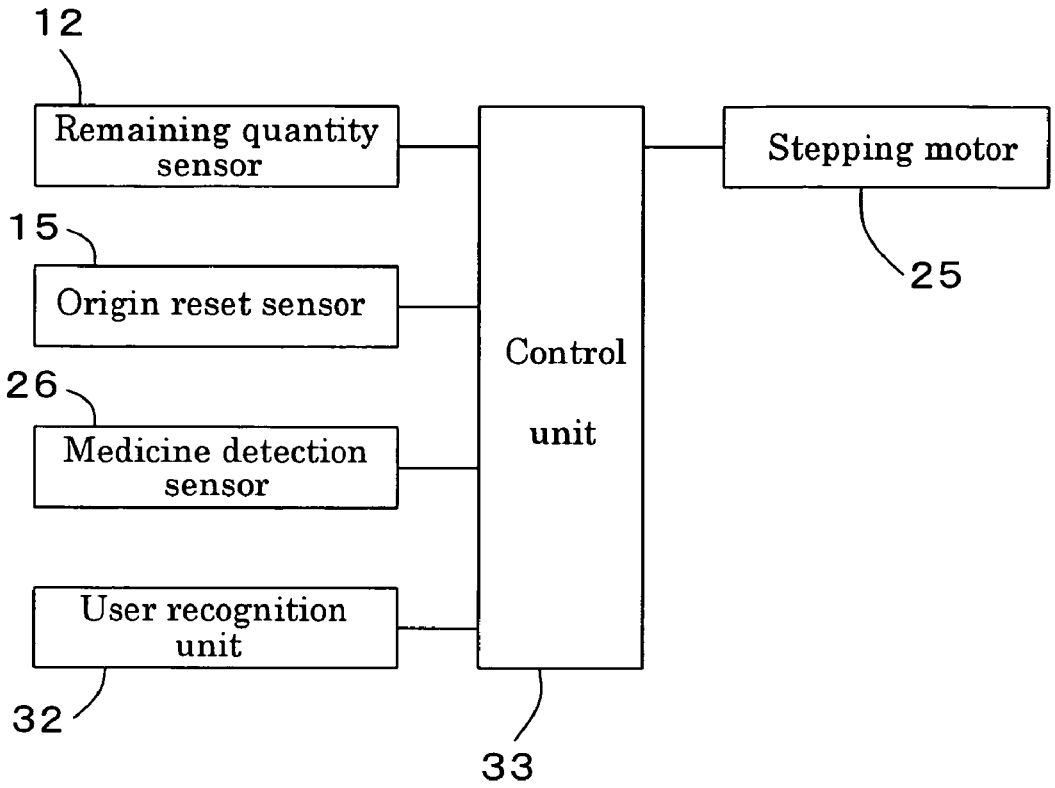
FIG. 9 is a block diagram showing the medicine feeder in the present embodiment.

As shown in FIG. 9, in addition to input signals and processing data from the remaining quantity sensor 12, the origin reset sensor 15 and the medicine detection sensor 26, input signals of a user recognition unit 32 are also inputted into a control unit 33. The control unit 33 controls driving of the stepping motor 25 and the like in response to the input signals. The user recognition unit 32 can adopt various recognition means such as use of user IDs and passwords, finger print recognition and iris recognition. Only when a pre-registered person who is authorized to discharge medicines is recognized, the medicines D can be extracted by driving the stepping motor 25 and the like.

Figure 10:
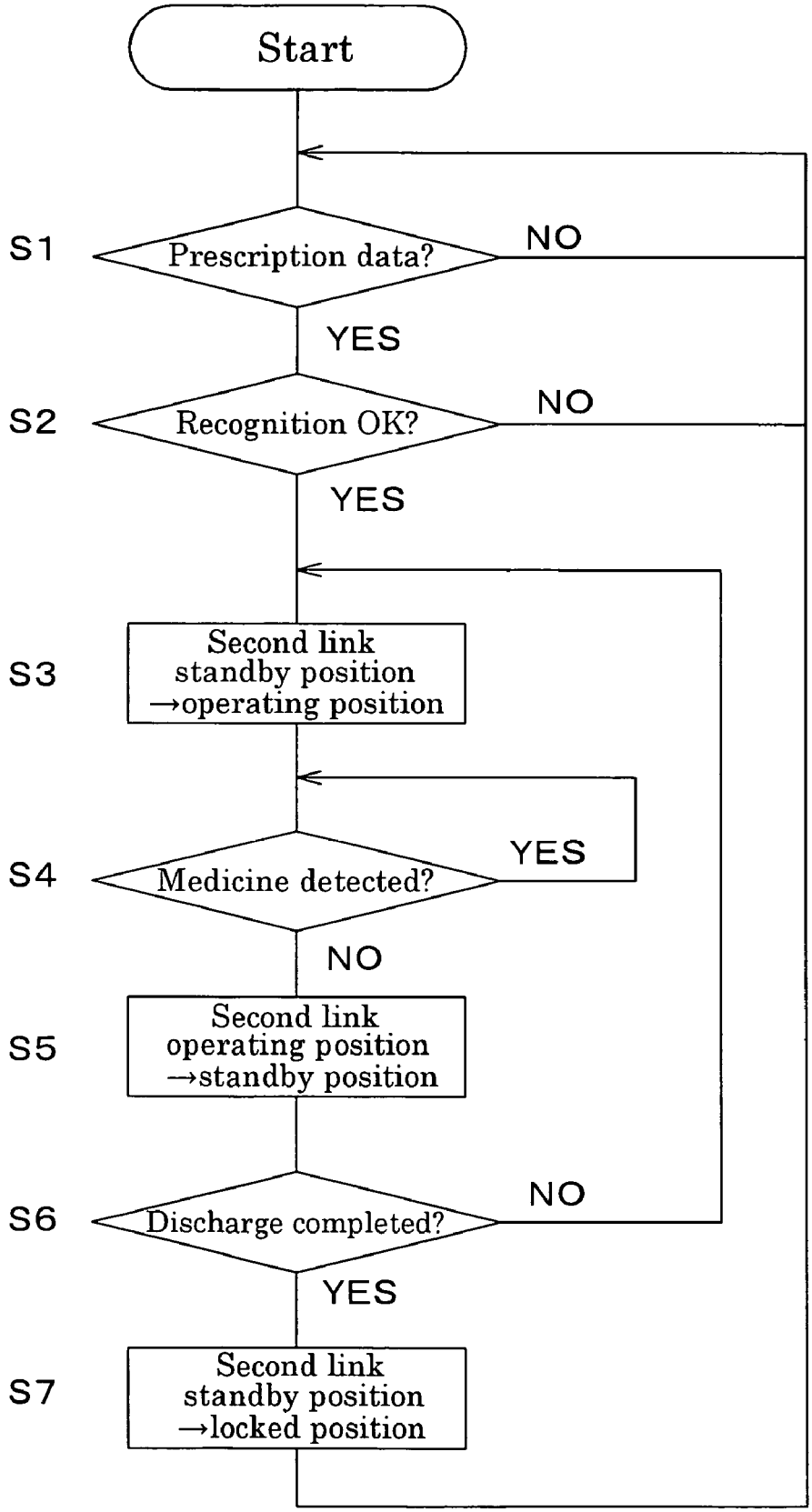
FIG. 10 is a flow chart showing the operation process in the medicine feeder in the present embodiment.

Description is now given of the operation of the above-structured medicine feeder with reference to the flow chart in FIG. 10. In the medicine feeder, medicines D are housed in each cassette 2 in the state of being arrayed in a row. In this state, the biasing force of the constant-load spring 6 acts on the housed medicines D through the slide member 5, and a medicine D positioned in the forefront is held in the holding recess portion 18 of the rotor 16 positioned at the reception position.

Figure 4A:
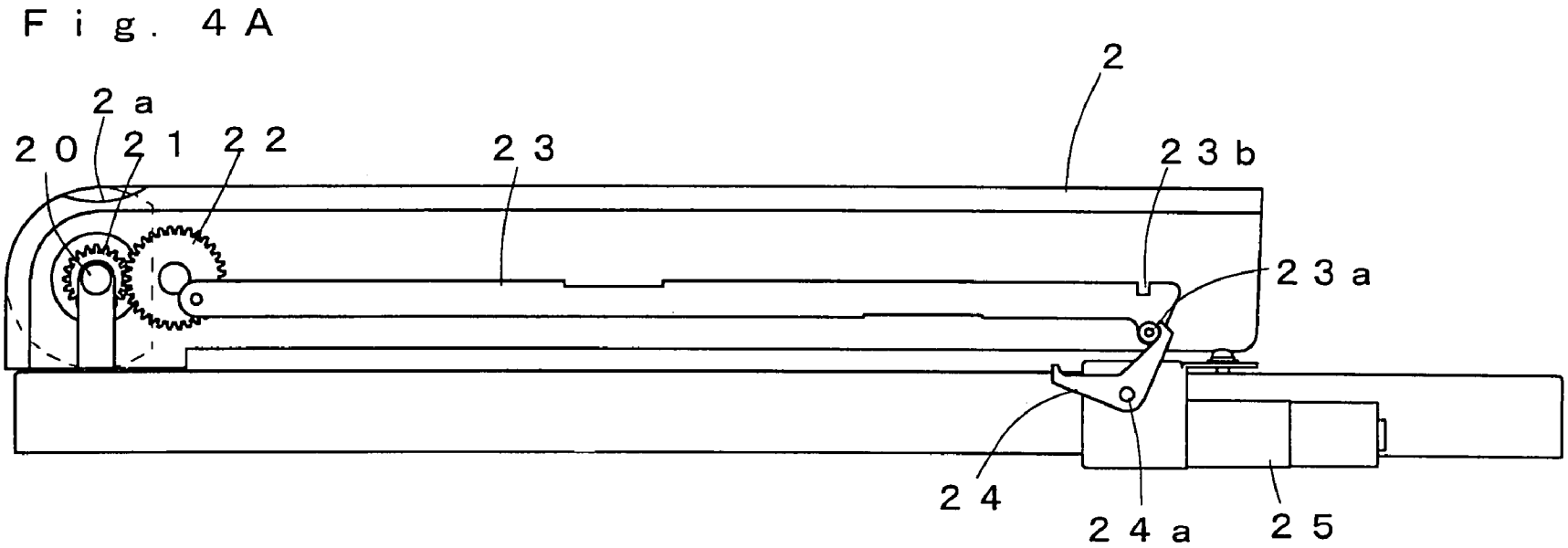
FIG. 4A is a side view showing the cassette shown in FIG. 1.
Figure 4C:
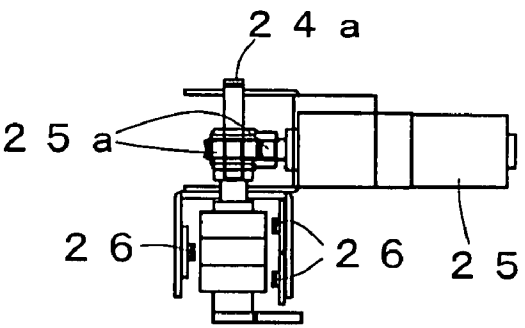
FIG. 4C is an enlarged view showing a stepping motor portion.
Figure 4B:
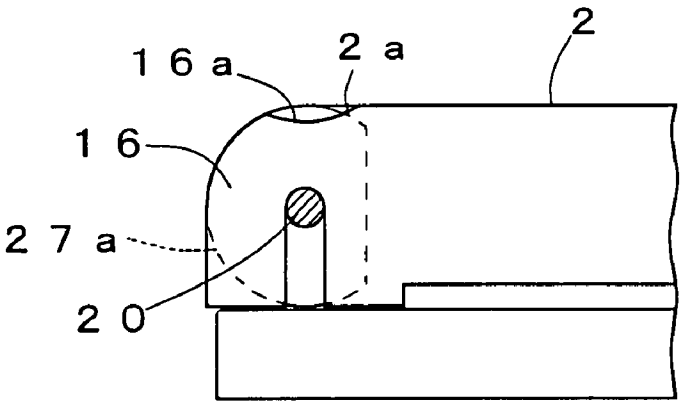
FIG. 4B is an enlarged view showing a rotor portion.
Figure 5:
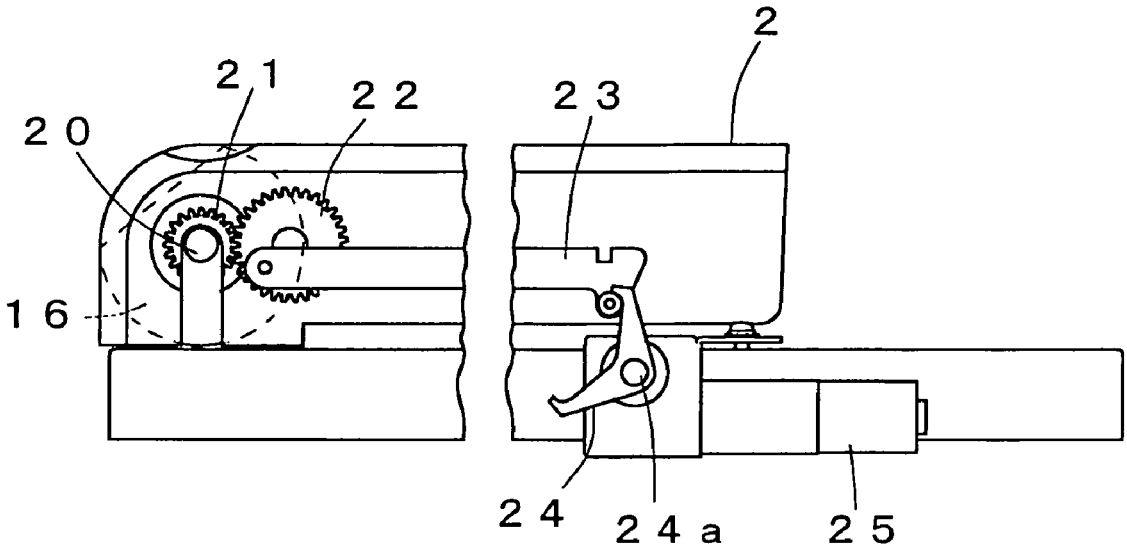
FIG. 5 is a view showing the cassette shown in FIG. 4A in a medicine discharge state.
Figure 6:
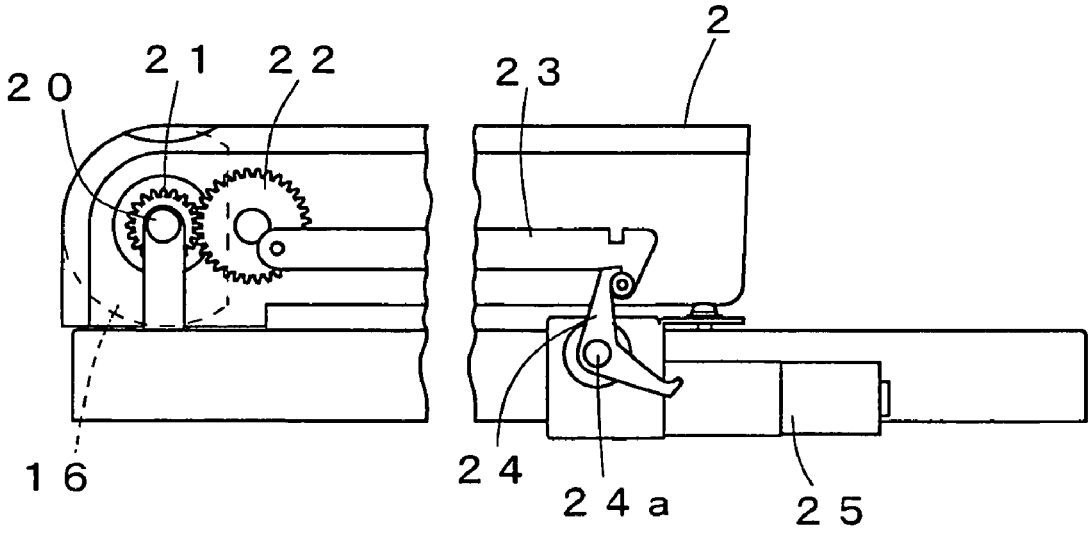
FIG. 6 is a view showing the cassette shown in FIG. 4A in a locked state.

If prescription data input is performed (step S1), and recognition in the user recognition unit 32 is properly performed (step S2), then based on the prescription data, the stepping motor 25 is driven for a predetermined period of time in the cassette 2 housing an appropriate medicine D, by which the second link 24 rotates to the operating position shown in FIG. 5 from the standby position shown in FIG. 4A (step S3). By this, the rotor 16 rotates from the reception position to the discharge position through the gear 25*a*, and the medicine D held in the holding recess portion 18 is moved to a dischargeable position on the front side. In this case, since the notch 19 is formed on the rotor 16, the medicine D can be grasped via the notch 19, thereby allowing easy extraction of the medicine D from the holding recess portion 18. At this point, it is detected whether or not the medicine D is extracted from the holding recess portion 18 based on the detection signal in the medicine detection sensor 26 (step S4), and if it is determined that the medicine D is extracted, then the stepping motor 25 is driven in a backward direction to rotate the second link 24 from the operating position shown in FIG. 5 to the standby position shown in FIG. 4A (step S5), by which the rotor 16 is rotated to the reception position. Eventually, the next medicine D is held in the holding recess portion 18. Afterward, a specified quantity of medicines D are discharged in the same manner. After that, when discharge of a specified quantity of medicines is completed and the rotor 16 is rotated to the reception position (step S6), the second link 24 is rotated from the standby position shown in FIG. 4A to the locked position shown in FIG. 6 (step S7), by which the rotor 16 is disabled from rotating. As a result, it becomes impossible to rotate the rotor 16 from the outside to extract medicines D without permission. Therefore, even if the medicines to be handled are narcotics, dangerous drugs and the like, appropriate management is achievable without paying extra attention.

It is to be noted that a quantity of the medicines D housed in the cassette 2 is detected by the encoder 11 and the remaining quantity sensor 12, which makes it possible to perform a specified display based on the detection signal and also to provide notification if the remaining quantity becomes low. In step S3, it is also possible to rotate the rotor 16 in a backward direction if a set time has passed without extraction of the medicine D from the holding recess portion 18 so as to prevent the medicine D from being left at the extraction position.

Figure 11A:
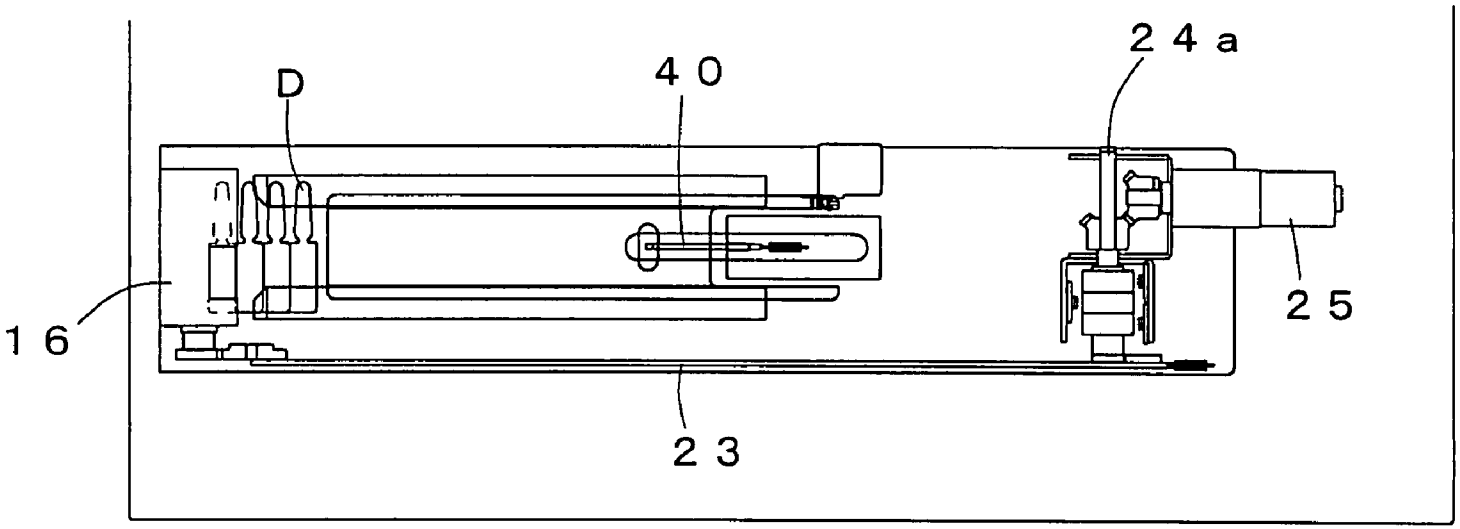
FIG. 11A is a plan view showing a cassette in another embodiment.
Figure 11B:
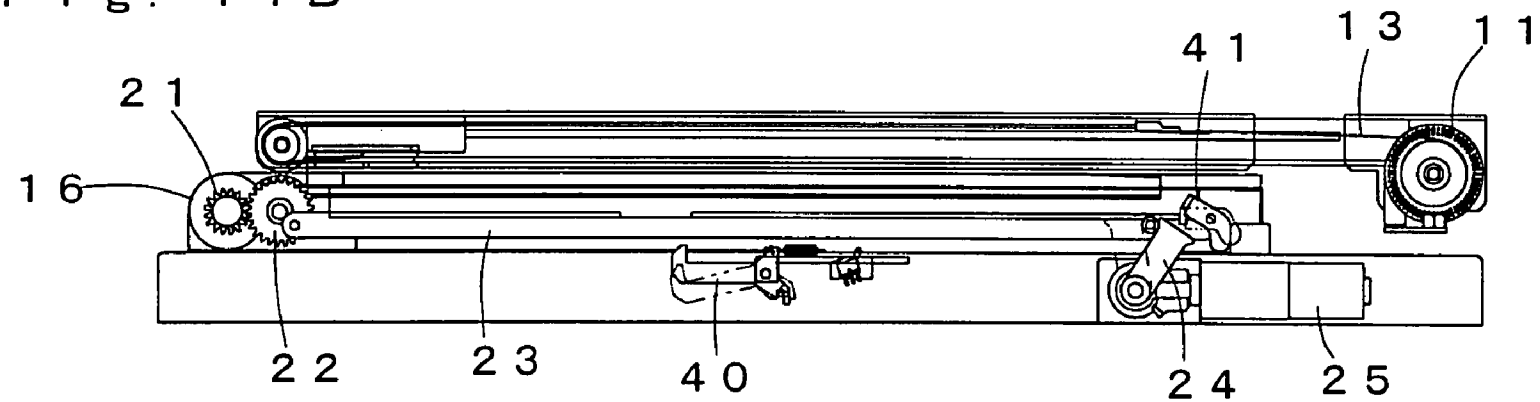
FIG. 11B is a side view of FIG. 11A.

Further, the shape of the second link 24 is not limited to the above-stated almost V shape but may take an almost I shape shown in FIGS. 11A and 11B. In FIGS. 11A and 11B, a position shown by a solid line is the discharge position and a position shown by a dotted line is the locked position.

Figure 12:
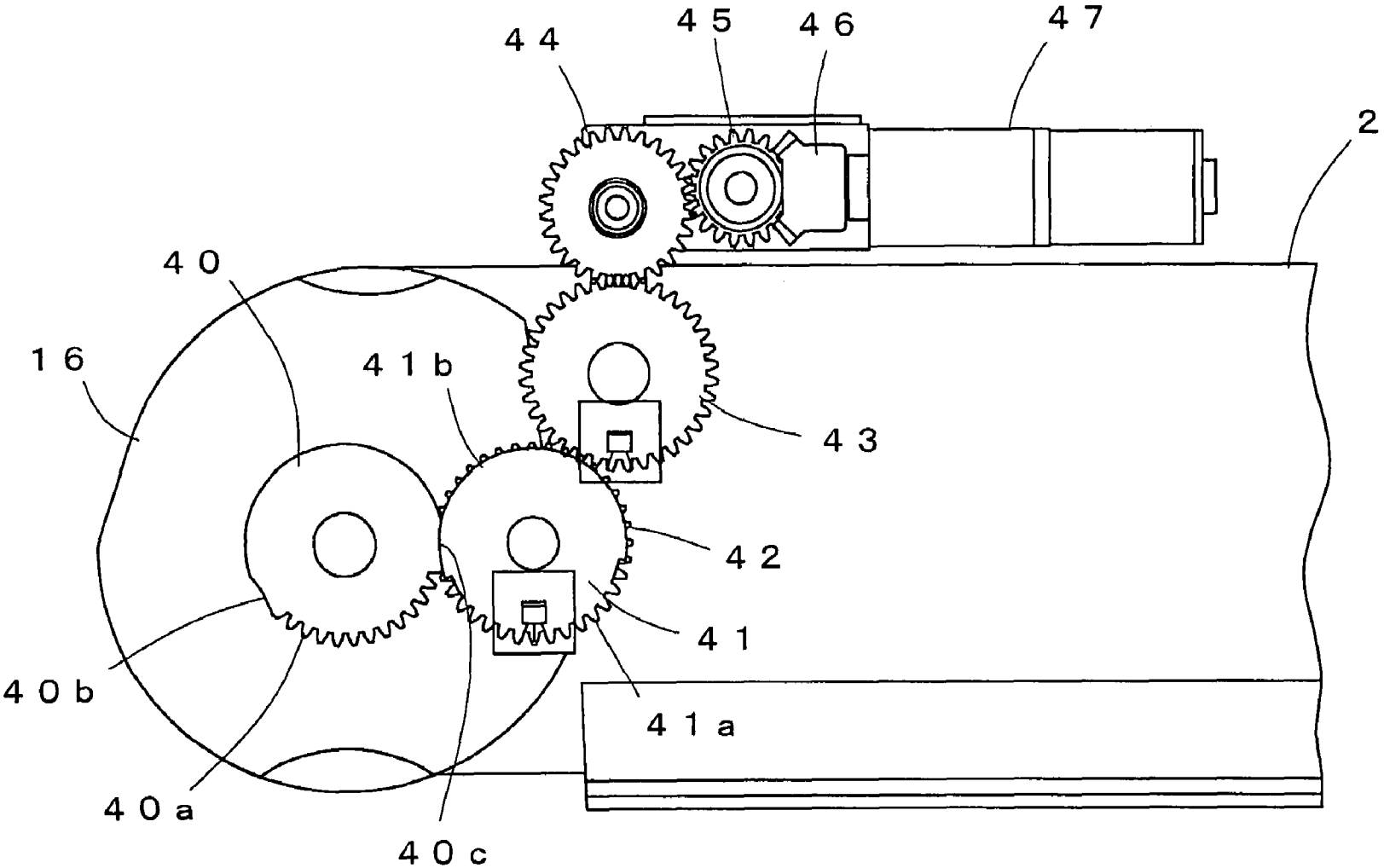
FIG. 12 is a schematic view showing a rotational driving mechanism of a rotor in another embodiment.

Further, although the first gear 21 is provided on the shaft portion 20 of the rotor 16 and is engaged with the second gear 22, the gears 21, 22 may be replaced with intermittent gears 40, 41 shown in FIG. 12. The intermittent gear 40 is structured such that on both sides of teeth portion 40*a*, release recess portions 40*b*, 40*c* are respectively formed in succession. The intermittent gear 41 is integrated with the guide plate 42, and sequential engagement of the gears 43 to 46 transmits driving force of a motor 47. The rotor 16 is rotated only when the teeth portions 40*a*, 41*a* of the intermittent gears 40, 41 are engaged. When the motor 47 is driven in the forward direction to rotate the rotor 16 from the reception position to the discharge position, a circular portion 41*b* of the intermittent gear 41 slides through the release recess portion 40*b* to securely prevent further rotation. If the motor 47 is driven in the backward direction, the teeth portions 40*a*, 41*a* of the intermittent gears 40, 41 are engaged again to rotate the rotor 16 from the discharge position to the reception position. Then, the circular portion 41*b* of the intermittent gear 41 slides through the release recess portion 40*c* of the intermittent gear 40, by which the rotor 16 is positioned at the reception position. Therefore, without high-precision management of the driving time of the motor 47, the rotor 16 can be securely positioned at both the discharge position and the reception position. In addition, when the circular portion 41*b* is positioned at the release recess portions 40*b*, 40*c*, the rotor 16 is in the locked state and cannot be rotated by operation from the outside.

Further, although the cassettes 2 are horizontally disposed so as to be stacked in a vertical direction, they can also be disposed vertically or at a slant. This make it possible to arbitrarily change the shape of the stock shelf 1 according to installation space. For example, in the case where the installation space of the stock shelf 1 can be formed only on the lower side, the cassette 2 may be disposed vertically and the medicines D may be structured to be extracted from the upper face side. Further, the cassette 2 can be disposed sideways so that vials and the like are disposed with their lid sides facing upward.

Figure 13A:
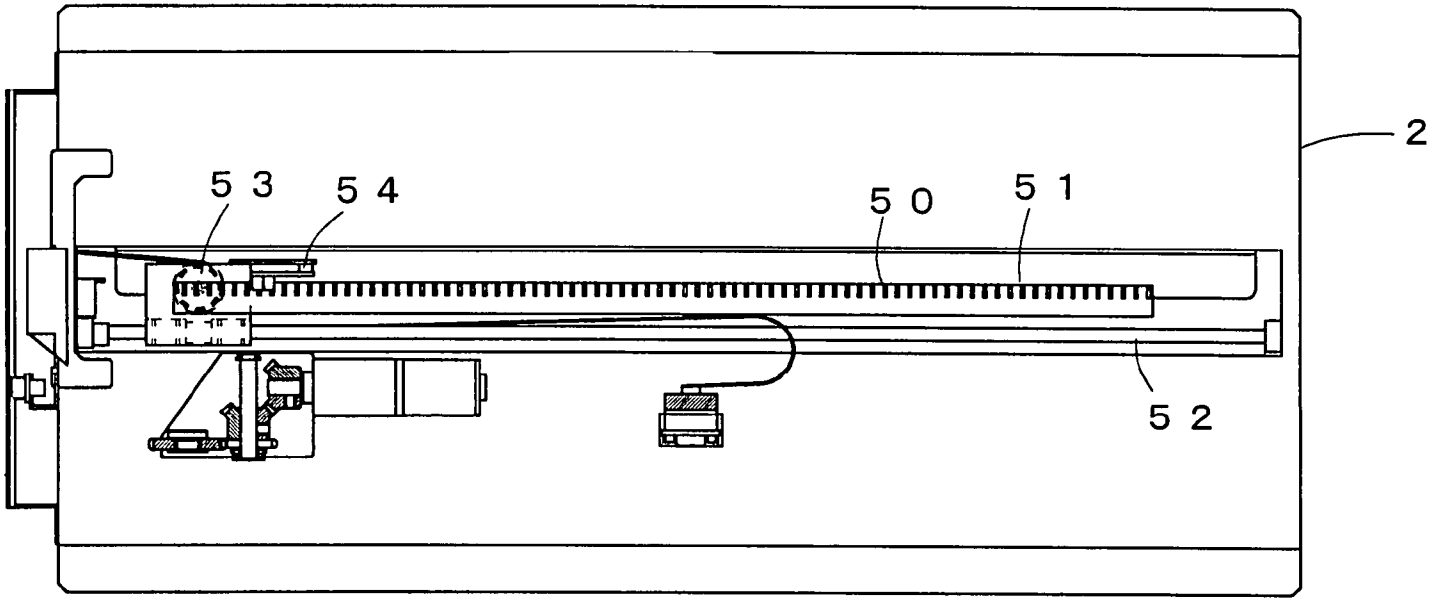
FIG. 13A is a plan view showing a cassette having an encoder in another embodiment.
Figure 13B:
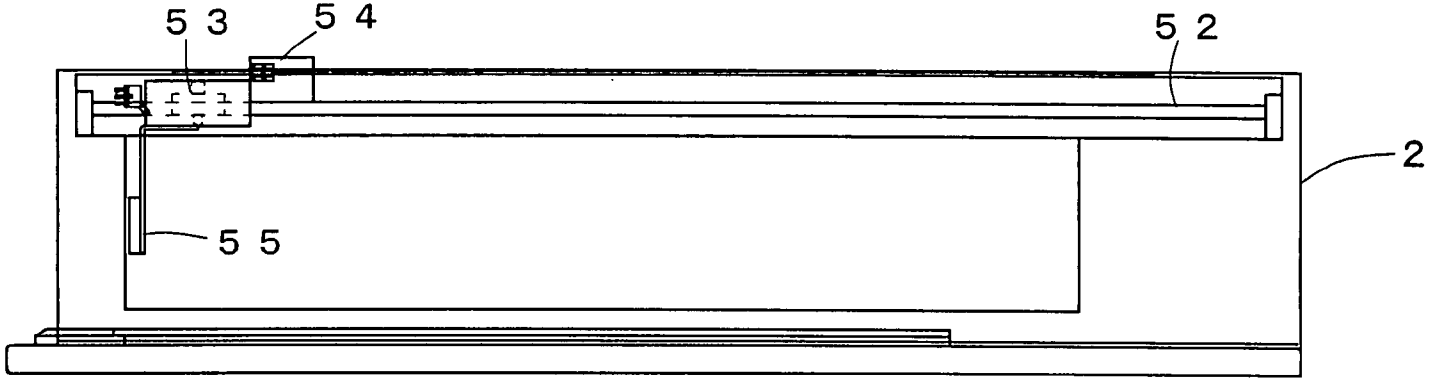
FIG. 13B is a front view of FIG. 13A.

FIGS. 13A and 13B show an encoder in another embodiment. Herein, a disc-shaped encoder is replaced with a long plate-shaped encoder. More particularly, there is disposed an encoder 51 having a plurality of slits 50 formed at specified intervals in parallel with a slide shaft 52 extending from the front side to the back side. Moreover, a constant-load spring 53 and a position detection sensor 54 are slidably mounted on the slide shaft 52. A spring portion 53*a* of the constant-load spring 53 is fixed to the front side, and a slide member 55 integrated with the constant-load spring 53 presses the medicines D in the cassette 2 toward the front side. The position detection sensor 54 detects the slits 50 of the encoder 51, and its detection signal is used to identify the position of the slide member 55, i.e., a quantity of the medicines D in the cassette 2.

Figure 14:
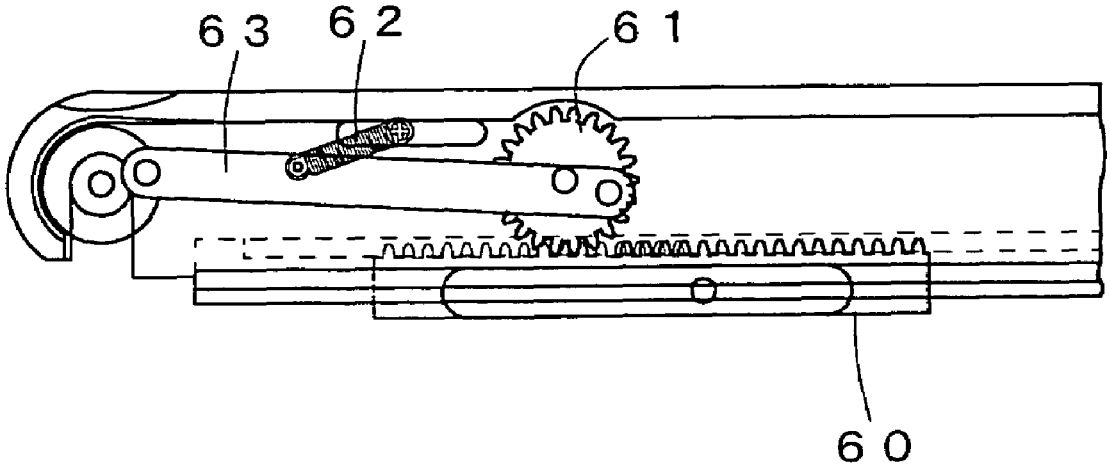
FIG. 14 is a schematic view showing a rotational driving mechanism of a rotor in another embodiment.

FIG. 14 shows a rotational driving mechanism of a rotor 16 in another embodiment. In the rotational driving mechanism, a pinion 60 is reciprocally moved in backward and forward directions (longitudinal direction in FIG. 14) by a solenoid (not shown) or the like, by which a rack 61 is rotated so as to position the rotor 16 (herein not shown) at the reception position and the discharge position, respectively, through a link 63 against the biasing force of a spring 62.

Figure 15A:
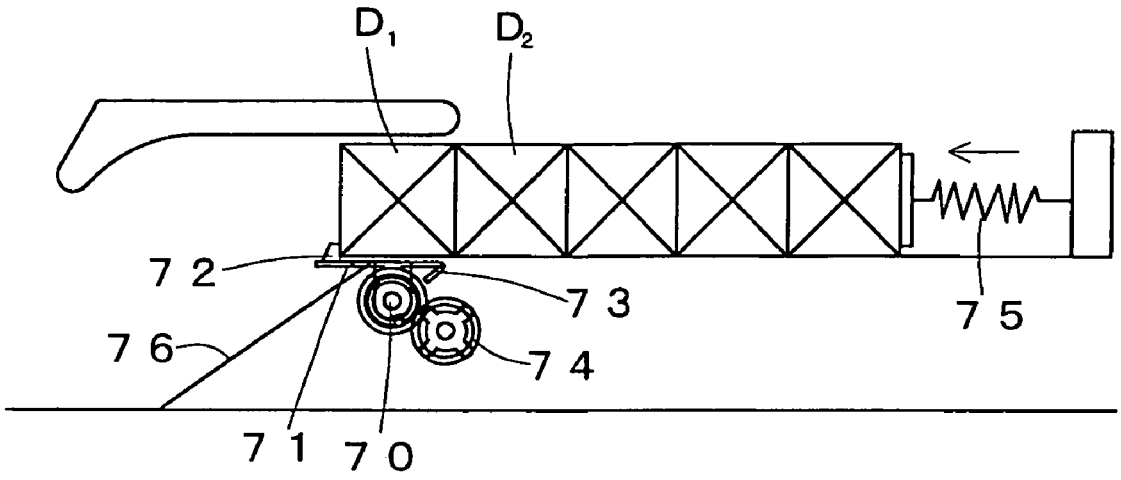
FIG. 15A and FIG. 15B are schematic views showing a discharge mechanism in another embodiment.
Figure 15B:
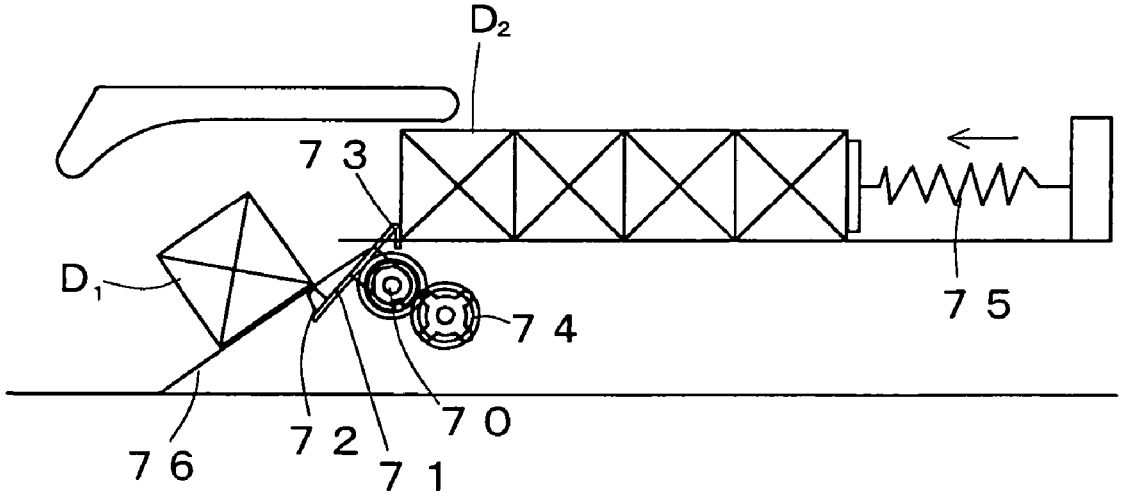

FIGS. 15A and 15B show a discharge mechanism in another embodiment. In this discharge mechanism, a discharge plate 71, which is rotatable around a spindle 70, is provided instead of the rotor 16. On one edge of the discharge plate 71, a first coupling portion 72 which couples with a medicine D1 positioned in the forefront is formed, while on the other edge of the discharge plate 71, a second coupling portion 73 which can support the next medicine D2 is formed. The discharge plate 71 rotates through a gear 74 by driving of a motor (not shown). The medicines D in the cassette 2 are biased toward the front side by a spring 75 provided on the back side, and an inclined plate 76 is provided at the discharge position on the front side.

In such a discharge mechanism, for discharging the medicines, a motor (not shown) is driven to rotate the removing portion 71 counterclockwise as shown in FIG. 15B. Consequently, the coupling state by the 72 first coupling portion is cancelled, and the medicine D1 positioned in the forefront slides down the inclined plate 76. At this point, the second coupling portion 73 couples with the next medicine D2, which makes it possible to reliably discharge only the medicine D1 in the forefront.

Figure 20:
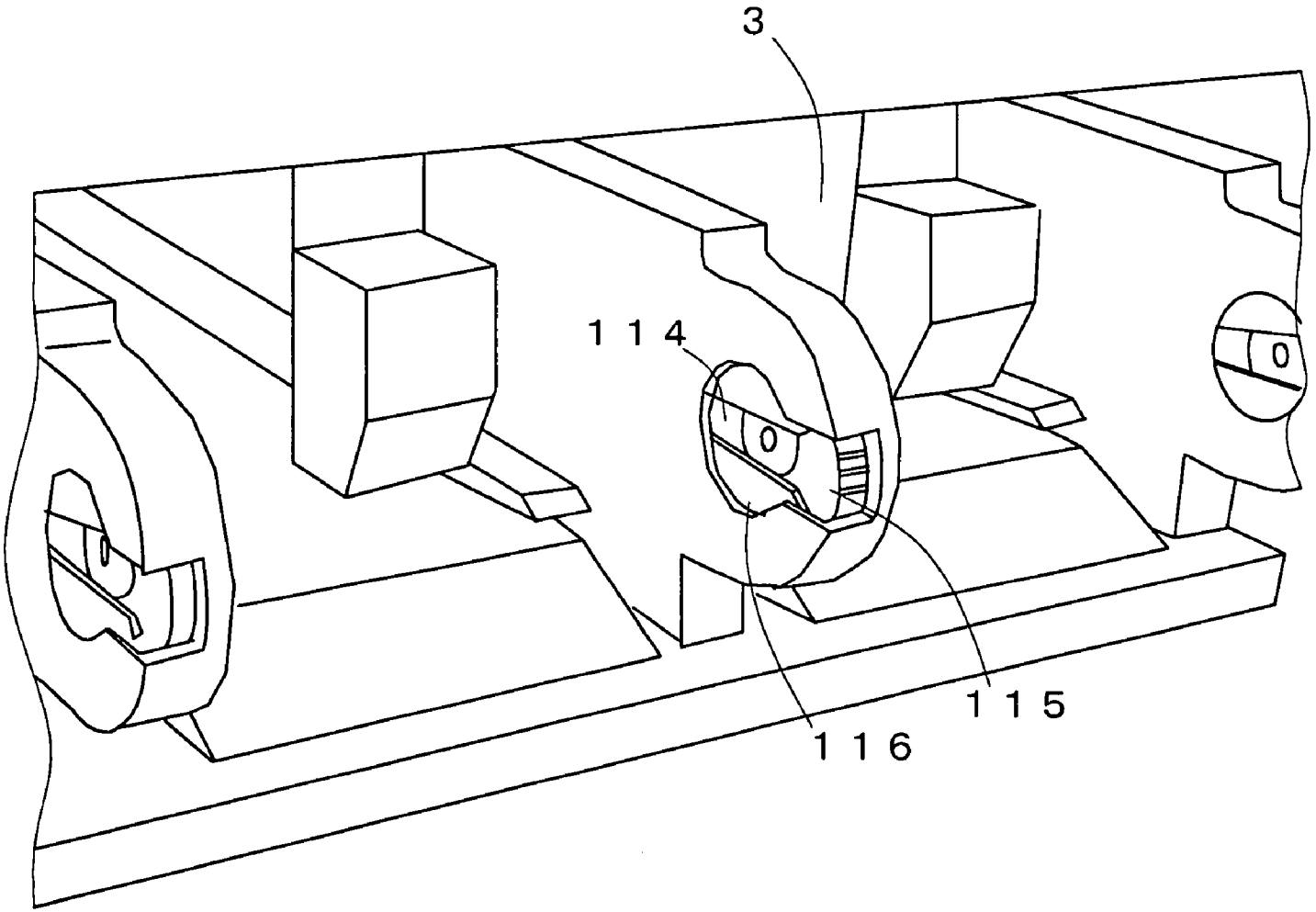
FIG. 20 is a fragmentary perspective view showing a housing portion in the another embodiment.
Figure 21A:
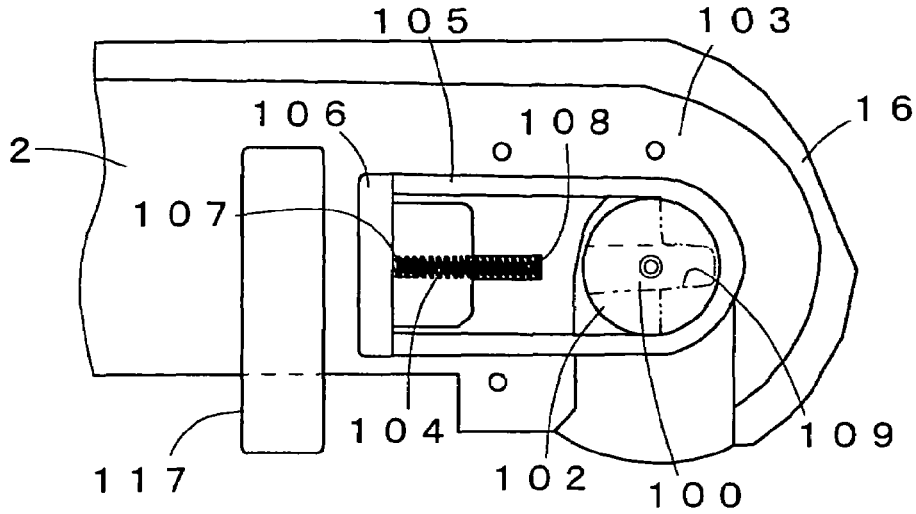
FIG. 21A is a side view showing the side of a lock member of the rotational driving mechanism of the rotor in the another embodiment before the cassette is mounted on the housing portion.
Figure 21B:
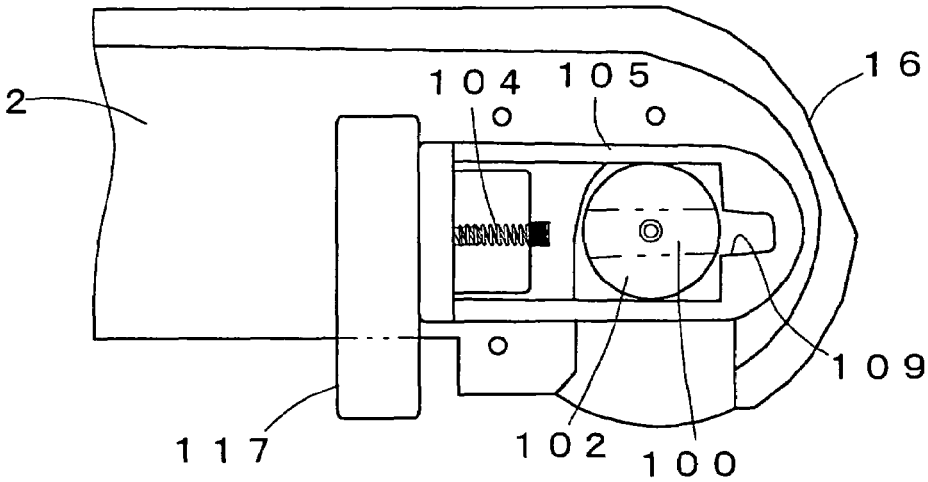
FIG. 21B is a side view showing the rotational driving mechanism of the rotor in the another embodiment before the cassette is mounted on the housing portion.
Figure 22A:
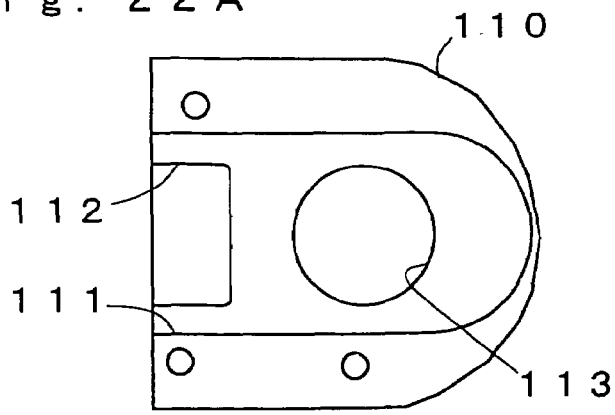
FIG. 22A is a plan view showing a cover mounted on the cassette.
Figure 22B:
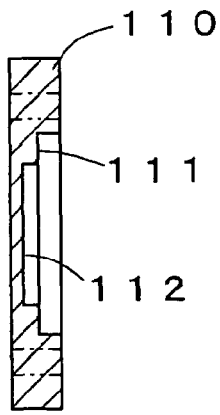
FIG. 22B is a cross sectional view of FIG. 22A.

FIG. 17 to FIG. 22 show a rotational driving mechanism of a rotor 16 in still another embodiment. In the rotational driving mechanism, on a shaft portion 20 protruding from the central section on both the end faces of a rotor 16 provided on a cassette 2, discs 101, 102 having a guide protruding portion 100 are provided respectively. On the side of the disc 102, a lock member 103, shown in FIGS. 21A and 21B, is provided. The locking member 103 has a lock frame 105 biased toward the left side in the figure. In an indentation portion 106 on one end side of the lock frame 105, a protrusion 107 is formed on the inner face side, and the protrusion 107 and a groove portion 108 formed on the side face of the cassette 2 hold the spring 104. On the other end portion of the lock frame 105, there is formed a coupling groove 109 which couples with and uncouples from the guide protruding portion 100 on the disc 102. The spring 104 and the lock frame 105 are covered with a cover 110 fixed to the cassette 2 except the indentation portion 106. On the cover 110, there are formed a slide groove 111 through which the lock frame 105 slides, a first release recess portion 112 through which the indentation portion 106 can slide, and a second release recess portion 113 through which the disc 102 can rotate. Further, on the side of each housing portion 3 in the stock shelf 1, the intermittent gear 40 shown in FIG. 12 is replaced with a driving gear 115 having a coupling groove 114 on its central section as shown in FIG. 20, the driving gear 115 being coupled with and uncoupled from the guide protruding portion 100. The structure excluding the intermittent gear 40 is identical to that shown in FIG. 12. On one side wall constituting the housing portion 3, a notch portion 116 is formed so that the coupling groove 114 of the driving gear 115 is exposed. Consequently, when the cassette 2 is mounted on the housing portion 3, the guide protruding portion 100 can couple with the coupling groove 114. It is to be noted that by mounting of the cassette 2, a contact portion 117, with which the indentation portion 106 of the lock frame 105 comes into contact, is formed on the side face of the housing portion 3.

Figure 23A:
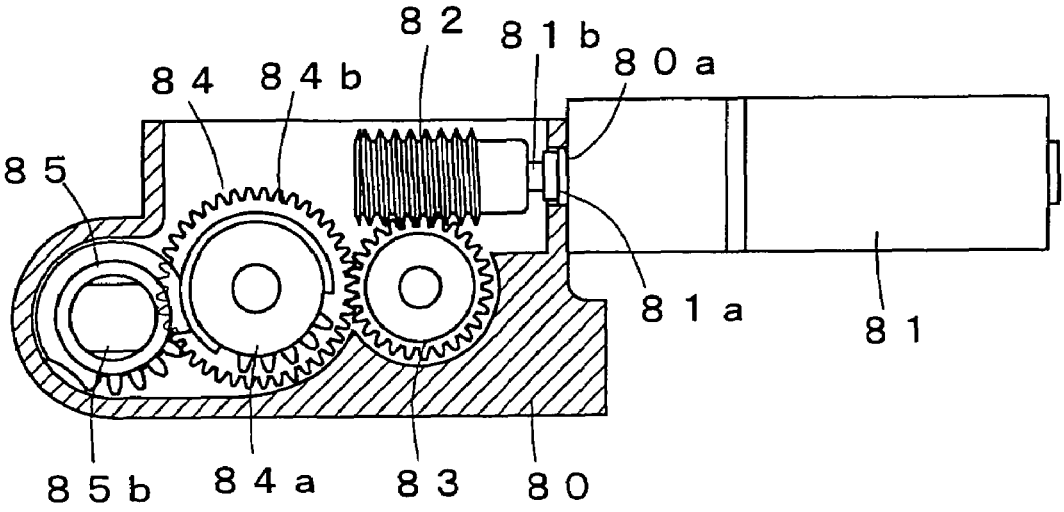
FIG. 23A is a cross sectional front view showing a rotational driving mechanism of a motor in still another embodiment.
Figure 23B:
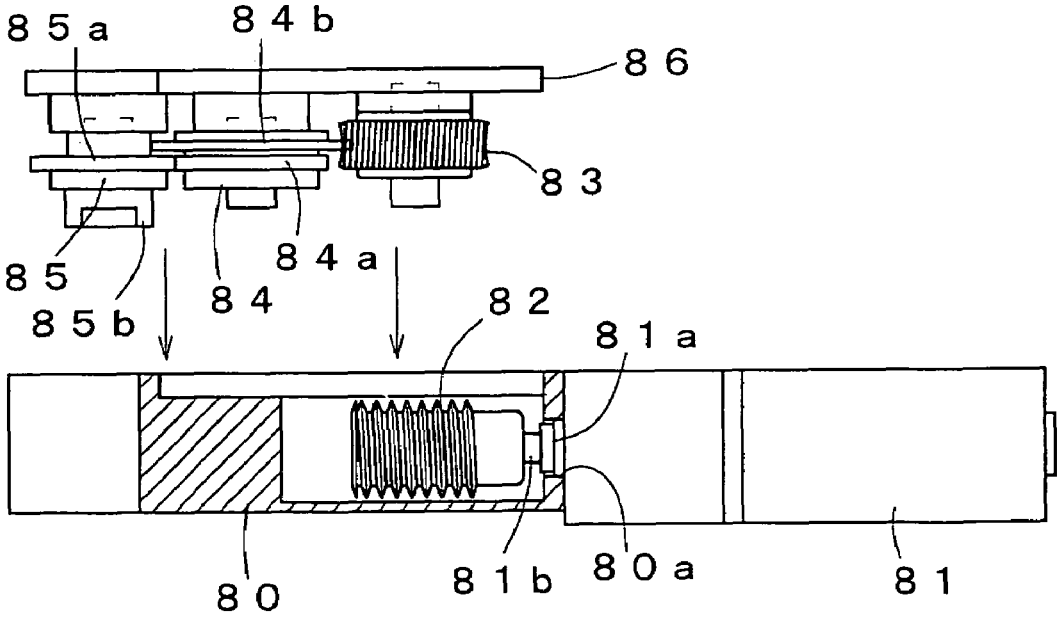
FIG. 23B is an exploded plan view of FIG. 23A.

FIGS. 23A and 23B show an example of the rotational driving mechanism of a rotor 16 in still another embodiment. The rotational driving mechanism is provided on a casing 80 attached to each housing portion 3 in the stock shelf 1, and driving force of a motor 81 is transmitted to a driving gear 85 through a worm gear 82, a worm wheel 83 and an intermediate gear 84.

The top face and the side face of the casing 80 are open and the side face is closed by a cover 86. On one end face of the casing 80, a through hole 80*a* is formed, and a bearing portion 81*a* of the motor 81 is fixed to the through hole 80*a*. The worm gear 82 is fixed to a spindle 81*b* protruding from the bearing portion 81*a* of the motor 81 and is disposed in the casing 80. The worm wheel 83, the intermediate gear 84 and the driving gear 85 are rotatably mounted on the cover 86. The intermediate gear 84 has a structure integrated with an intermittent gear 84*a* and a spur gear 84*b*, and the spur gear 84*b* is engaged with the worm wheel 83 while the intermittent gear 84*a* can engage with the driving gear 85. An intermittent gear is used in the driving gear 85, and on the top end face of the driving gear 85, a guide piece 85*b* protruding at a specified interval is formed. In the state in which the cover 86 is attached to the casing 80 with a screw or the like, the worm wheel 83, the intermediate gear 84 and the driving gear 85 are positioned in the casing 80, with the worm wheel 83 engaging with the worm gear 82.

Figure 18:
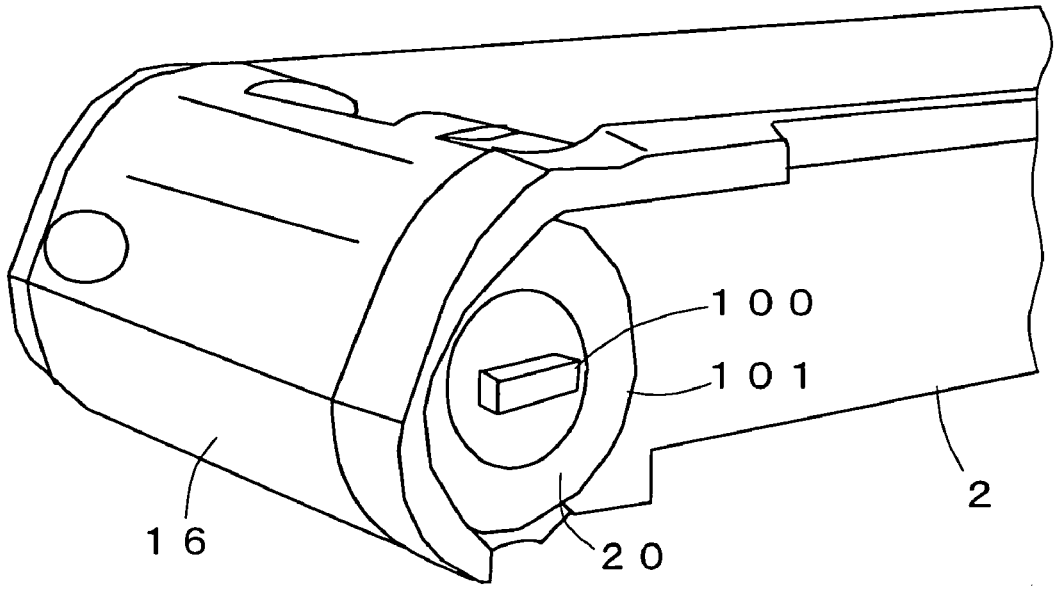
FIG. 18 is a perspective view showing a rotor portion of the cassette in the another embodiment.
Figure 19:
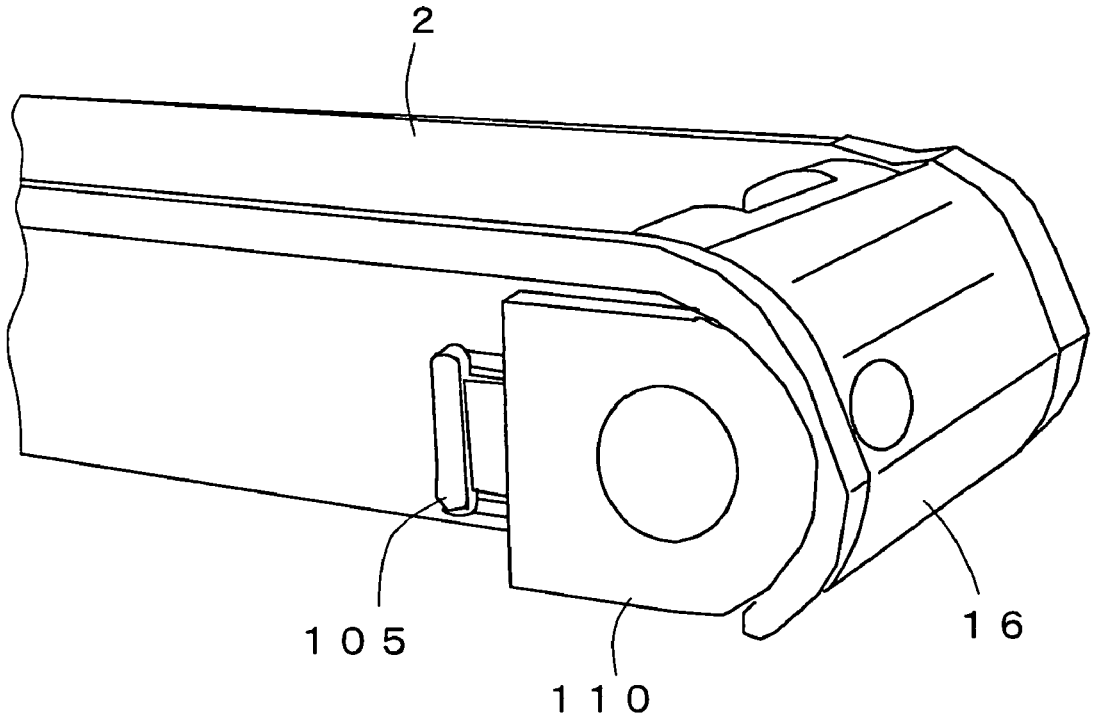
FIG. 19 is a perspective view viewed from the opposite side relative to that of FIG. 18.

The cassette 2 housed in the housing portion 3 has a rotor 16 on one end side as with the structure shown in the above-described FIG. 18, and on one side of a shaft portion 20 protruding from both end portions of the rotor 16, a guide protruding portion 100, guided by the guide piece 85*b* of the driving gear 85, is formed.

When the cassette 2 is mounted on the housing section 3 having the above-structured rotational driving mechanism, the rotor 16 is coupled with the torque transmission member 90. Consequently, by operating a protruding portion of the torque transmission member 90, the rotor 16 rotates, and the torque transmission member 90 is positioned at the discharge position or the reception position, so that the medicines D housed in the cassette 2 are discharged one by one. In the state that the rotor 16 is rotated to the reception position, the first gear 91, the second gear 92 and the third gear 93 rotate, and the slider 94 moves to a position shown in FIG. 24C. Then, at this position, the latch 96 couples with the coupling protruding portion 94*a*. As a result, the slider 94 is disabled from moving, and the torque transmission member 90, i.e., the rotor 16, is positioned at the discharge position through the third gear 93, the second gear 92 and the first gear 91. If the coupling state by the latch 96 is cancelled by further pressing down the protruding portion of the torque transmission member 90, the slider 94 moves to a position shown in FIG. 24B by biasing force of the spring 95, so that the third gear 93 rotates. At this time, by virtue of the damper 97, rapid rotation of the third gear 93 is prevented. Therefore, the rotational velocity of the torque transmission member 90 which rotates through the second gear 92 and the first gear 91 is suppressed, and so the rotor 16 smoothly returns to the reception position.

Figure 24A:
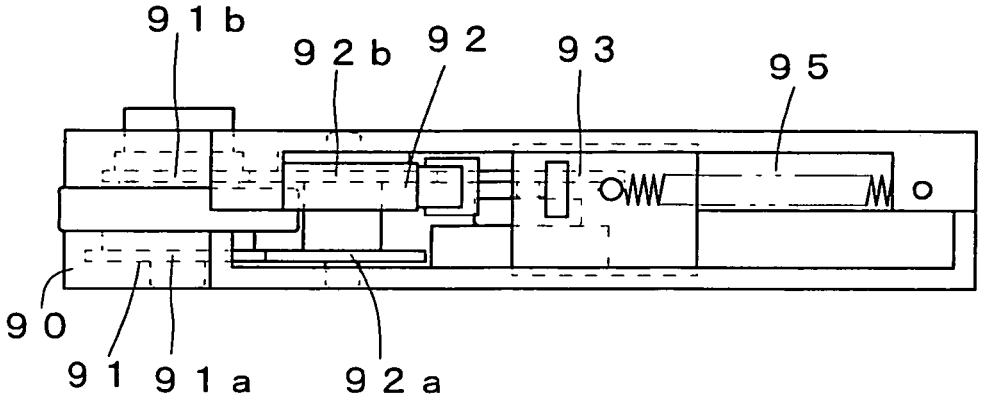
FIG. 24A is a cross sectional front view showing a rotational driving mechanism of a motor in another embodiment.
Figure 24B:
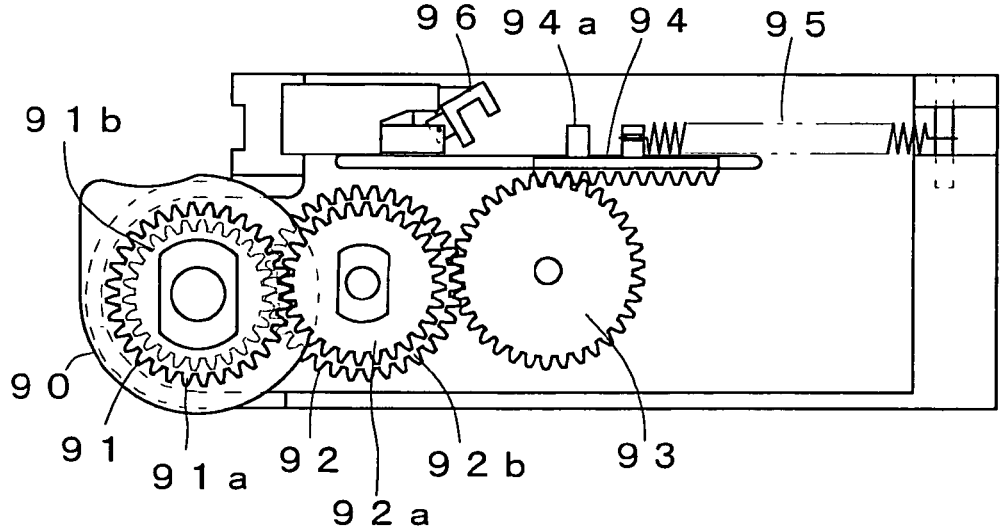
FIG. 24B is a front view of FIG. 24A.
Figure 24C:
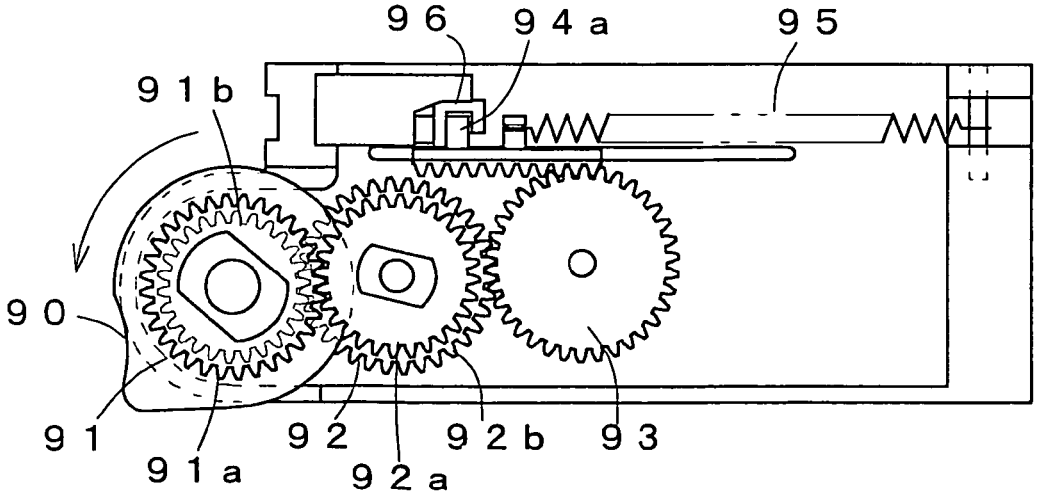
FIG. 24C is a front view showing the rotor of FIG. 24B in the state of being rotated.

FIGS. 24A, 24B and 24C show an example of the rotational driving mechanism of a rotor 16 in still another embodiment. The rotational driving mechanism is provided on each housing portion 3 in the stock shelf 1, and has a torque transmission member 90. When the cassette 2 is housed in the housing portion 3, a shaft portion 20 of a rotor 16 provided on one end portion of the cassette 2 couples with the torque transmission member 90 so as to rotate integrally. Also, the torque transmission member 90 is integrated with a first gear 91, and a slider 94 is interlocked with a second gear 92 and a third gear 93. The first gear 91 is formed by integrating spur gears 91*a*, 91*b*. The second gear 92 is formed by integrating spur gears 92*a*, 92*b* each engaged with the spur gears 91*a*, 91*b* of the first gear 91. The spur gear 92*a* engages with a gear provided on a spindle of a motor (not shown), while the spur gear 92*b* engages with the third gear 93. The slider 94 is biased in a direction away from the rotor 16 by the biasing force of a spring 95. A coupling protruding portion 94*a* is formed on the slider 94, and a latch 96 is coupled with the coupling protruding portion 94*a* so that the rotor 16 is positioned at the discharge position shown in FIG. 24C. Further, a damper 97 is provided on the third gear 93 for alleviating rapid rotation caused by the biasing force of the spring 95 when the latch 96 is released.

In the housing portion 3 having the above-structured rotational driving mechanism, when the cassette 2 is mounted thereon, the rotor 16 couples with the torque transmission member 90. Consequently, a motor (not shown) is driven to have rotation in forward and backward directions, and the rotor 16 rotates through the torque transmission member 90 so as to be positioned at the discharge position or the reception position, by which the medicines D housed in the cassette 2 are discharged singly (i.e., one at a time). When the rotor 16 is in the state of being rotated to the discharge position, the first gear 91, the second gear 92 and the third gear 93 rotate and the slider 94 moves to a position shown in FIG. 24C. Then, at this position, the latch 96 couples with the coupling protruding portion 94*a*. As a result, the slider 94 is disabled from moving, and the torque transmission member 90, i.e., the rotor 16, is positioned at the discharge position through the third gear 93, the second gear 92 and the first gear 91. If the coupling state by the latch 96 is cancelled, the slider 94 moves to a position shown in FIG. 24B by the biasing force of the spring 95, so that the third gear 93 rotates. At this time, by virtue of the damper 97, rapid rotation of the third gear 93 is prevented. Therefore, the rotational velocity of the torque transmission member 90 which rotates through the second gear 92 and the first gear 91 is suppressed, and so the rotor 16 smoothly returns to the reception position.

Figure 43:
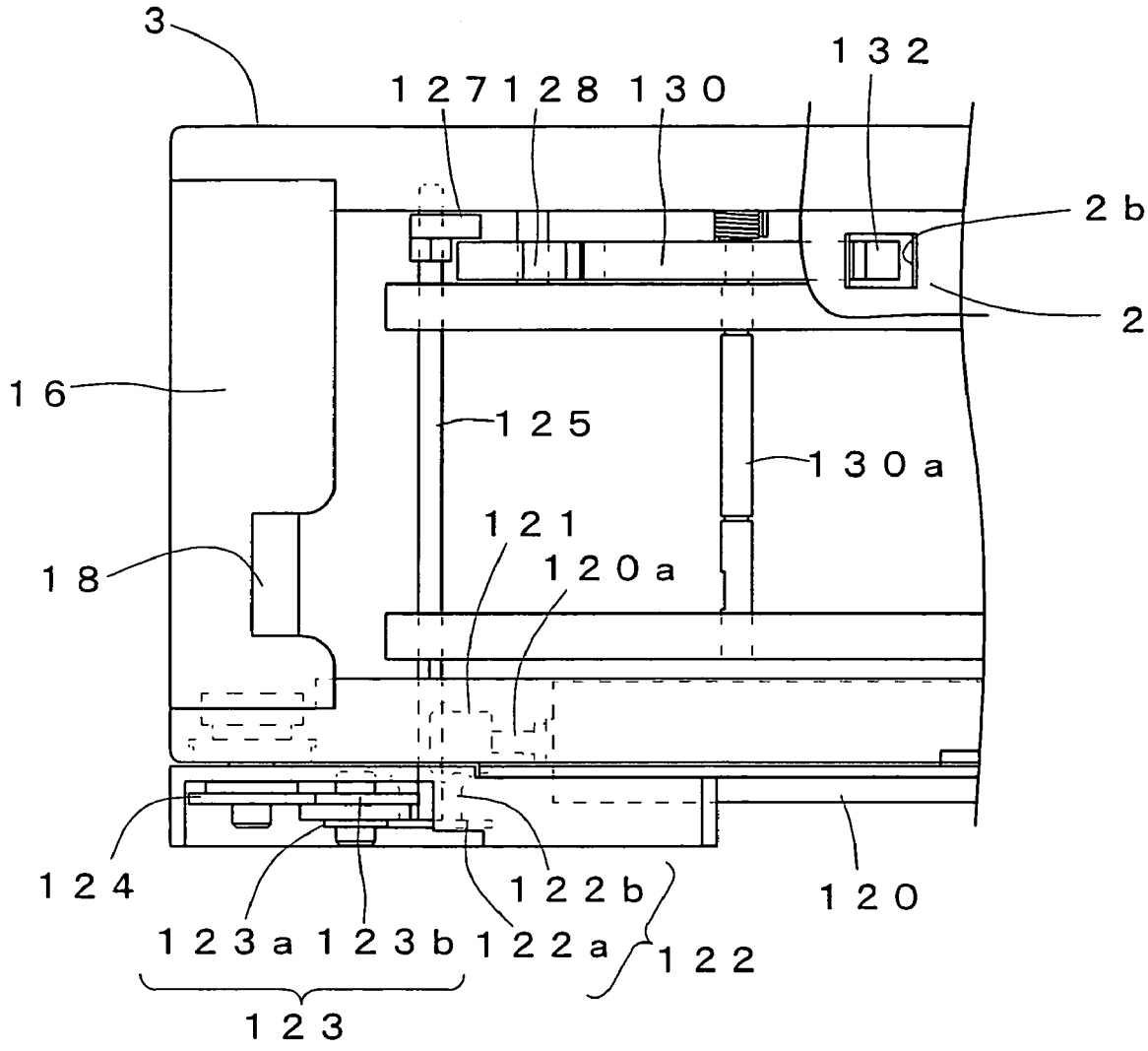
FIG. 43 is a perspective view showing a rotor portion of a cassette in another embodiment.
Figure 44A:
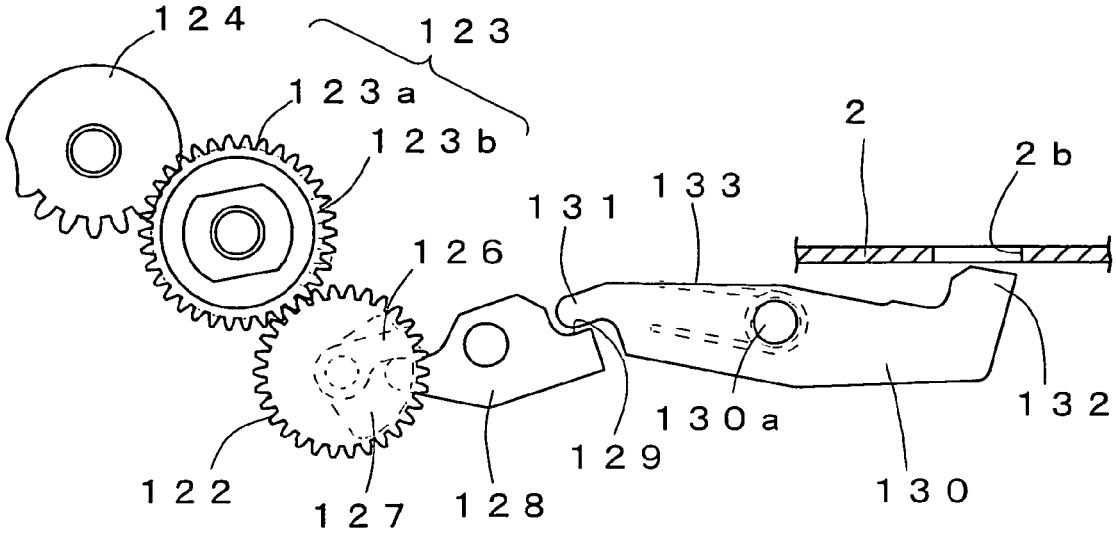
FIG. 44A is a schematic explanatory view showing a rotational driving mechanism shown in FIG. 43 in an unlock position.
Figure 44B:
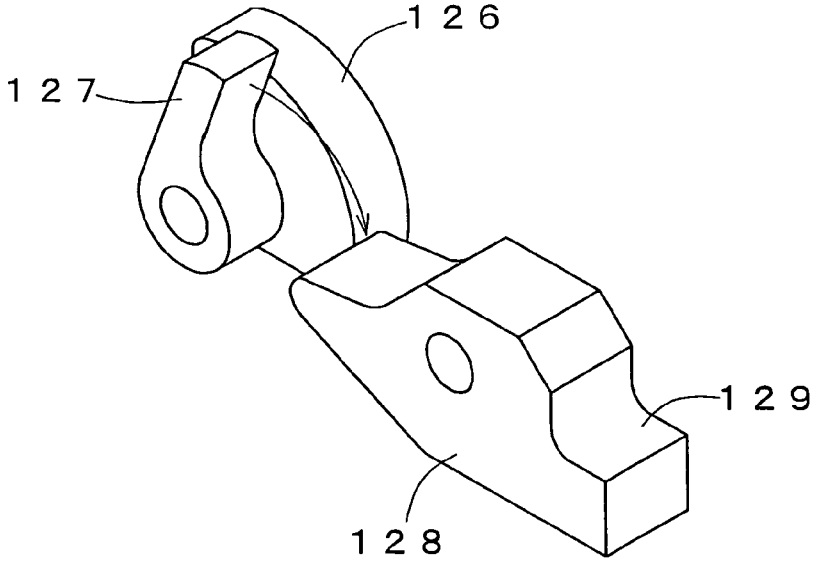
FIG. 44B is a fragmentary detailed perspective view of FIG. 44A.

FIGS. 43 to 45 show an example of the rotational driving mechanism of a rotor 16 in still another embodiment. The rotational driving mechanism is provided in each housing portion 3 in the stock shelf 1. In the state that the cassette 2 is mounted on the housing portion 3, driving force of a motor 120 is transmitted from a driving gear 121 provided on its spindle 120*a* to a driven gear 124 provided on a shaft portion of the rotor 16 through a first intermediate gear 122 and a second intermediate gear 123, by which the rotor 16 is rotated. The first intermediate gear 122 is provided on one end portion of a shaft member 125, and a cam 126 is attached to the other end portion of the shaft member 125. The cam 126 has a pressing piece 127 and rotates around the shaft member 125 so that the pressing piece 127 presses one end portion of a first link 128, which is rotated around a spindle 128*a*. The first link 128 has a connecting recess portion 129 in one end portion, and on the connecting recess portion 129, a connecting portion 131 formed on one end side of a second link 130 which is rotatably provided around a spindle 130*a* is slidably positioned. On the other end portion of the second link 130, a coupling portion 132 is formed, and the coupling portion 132 can be coupled with a coupling hole 2*b* formed on the bottom face of the cassette 2. The second link 130 is biased counterclockwise in FIG. 4A by a spring 133 externally mounted on the spindle 130*a*. The first intermediate gear 122 is formed by integrating a first gear 122*a* formed from a helical gear and a second gear 122*b* formed from a spur gear. The first gear 122*a* engages with the driving gear 121. The second intermediate gear 123 is formed by integrating a first gear 123*a* formed from a spur gear which is engaged with the first gear 122*a* of the first intermediate gear 122 and a second gear 123*b* formed from an intermittent gear. The driven gear 121 is formed from an intermittent gear similar to the second gear 123*b* of the second intermediate gear 123, and operates with the intermediate gear 123 only in the range of a specified angle at which the second intermediate gear 123 rotates to rotate the rotor 16. The structure for rotating the rotor 16 by using an intermittent gear is similar to that shown in FIG. 12.

Figure 45A:
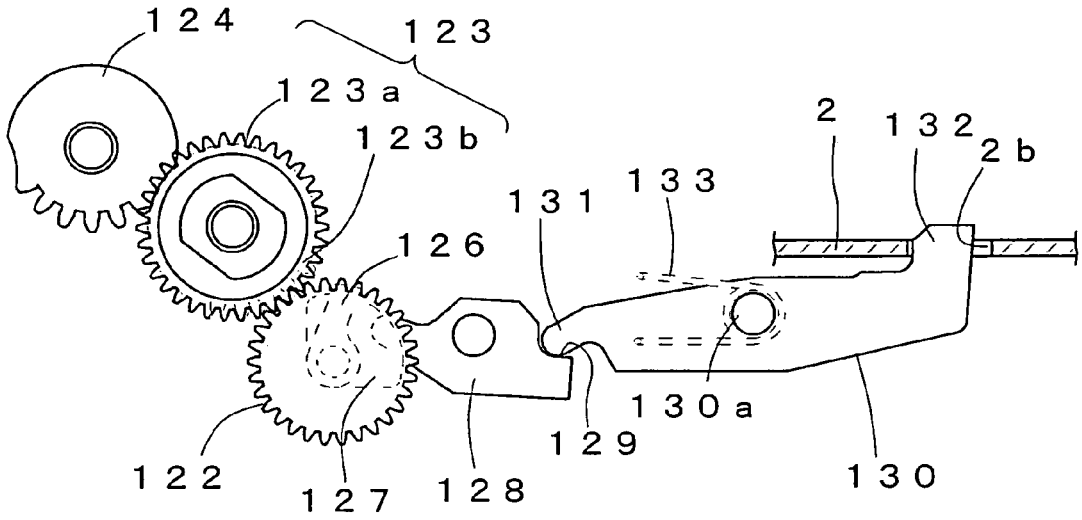
FIG. 45A is a schematic explanatory view showing the rotational driving mechanism shown in FIG. 43 in a reference position.
Figure 45B:
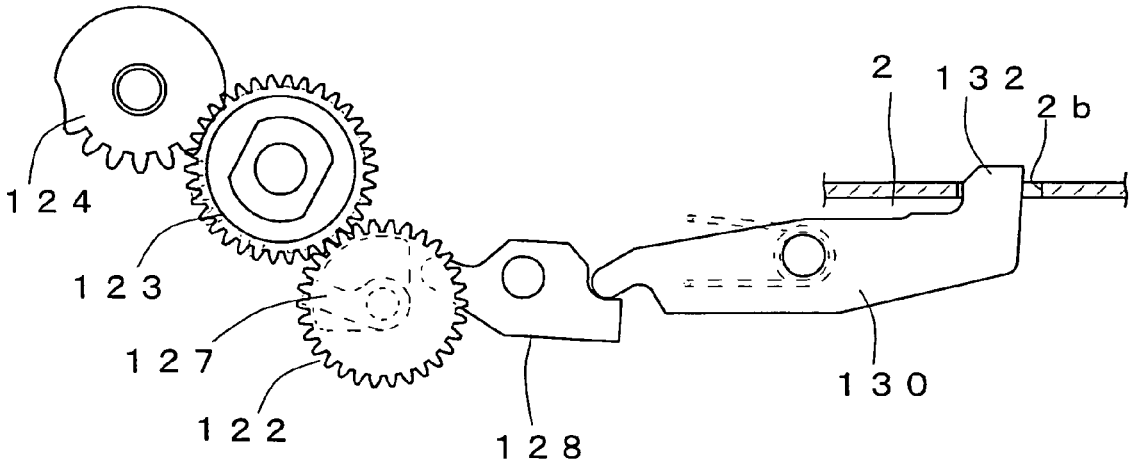
FIG. 45B is a schematic explanatory view showing the rotational driving mechanism shown in FIG. 43 in an unlock position.
Figure 45C:
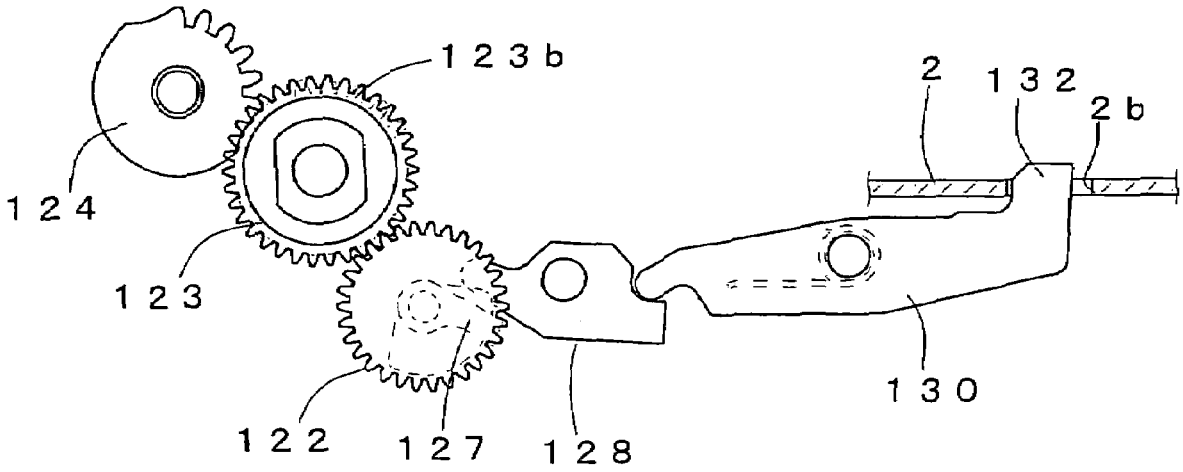
FIG. 45C is a schematic explanatory view showing the rotational driving mechanism shown in FIG. 43 in the state of being rotated to a discharge position.

If the cassette 2 having the above-structured rotational driving mechanism is mounted on the housing portion 3, the coupling portion 132 of the second link 130 is coupled with the coupling hole 2*b* of the cassette 2 as shown in FIG. 45A. Also in the rotor 16, the driven gear 121 is partially engaged with the second gear 123*b* of the second intermediate gear 123, which prevents rotation by manual operation.

In the case of discharging medicines from the cassette 2, the motor 120 is driven in a forward direction so as to rotate the rotor 16 through each of the gears 121, 122, 123 and 124. The driving of the motor 120 in the forward direction rotates the first intermediate gear 122 counterclockwise, by which the driven gear 124 rotates from a position shown in FIG. 45B to a position shown in FIG. 45C. As a result, the rotor 16 is rotated from the reception position at which the medicine in the cassette 2 can be held in the holding recess portion 18 to the discharge position for discharging the medicines from the cassette 2. Consequently, the medicine held in the holding recess portion 18 of the rotor 16 is discharged. In this state, the pressing piece 127 of the cam 126 comes into contact with one end portion of the first link 128, which prevents the first link 128 from rotating. Therefore, the coupling portion 132 of the second link 130 maintains the coupling state with the coupling hole 2*b* of the cassette 2, which securely prevents the cassette 2 from falling from the housing portion 3 during a discharge operation of the medicines.

When discharge of the medicines is completed, the motor 120 is driven in a backward direction to rotate the rotor 16 from the discharge position to the reception position.

FIG. 25 to FIG. 42 show examples of display on an operation display panel 200. FIG. 25 shows a fingerprint recognition screen in the step S2. When the fingerprint recognition is performed, the display is switched to the screen shown in FIG. 26, and if OK button is selected, the display shifts to a various operations screen shown in FIG. 27, while if NG button is operated, the display returns to the fingerprint recognition screen.

In the various operations screen, there is displayed an anticancer drug management menu including a discharge operation button, a master maintenance button, an inquiry operation button, a replenishing operation button, a daily report button and an end button.

When the discharge operation button is operated, the display is switched to an auto/manual screen shown in FIG. 28. If the auto button is operated, the display is switched to a processed clients list screen shown in FIG. 29, and automatic medicine discharge processing is started.

In the processing clients list screen, prescription data is read, and client IDs, client names, departments and wards of the clients with unprocessed prescription are automatically displayed. By selecting a desired line, the display is switched to a discharge operating screen shown in FIG. 30, and information on a selected client (client ID, issued date, etc.) and the entire prescription details of the client are displayed. In this screen, a discharge quantity and the like are checked, and operations including addition, deletion and modification are performed. When the discharge button is operated, each line on the screen is displayed in reverse video in sequence from the top line and discharge processing is started.

In the discharge processing, inventory information on the cassette 2 housing an appropriate medicine is checked and if the medicine is out of stock, then a message thereof is displayed and the data is stored as unfinished information before inventory check for the next medicine is started. If the medicine is in supply, then discharge is started, and in the line of the pertinent medicine on the discharge operation screen, a status report for reporting the progress of the medicine discharge is displayed (e.g., showing a bar chart indicating the percentages of accomplishment). On the screen, the line that the discharge processing is completed is displayed in red, the line during discharge processing is displayed in green, and the line that the discharge processing is unfinished is displayed in white. It is to be noted that if the manual button is operated on the auto/manual screen, the display is directly switched to the processing clients list screen, and after pertinent data is inputted in each item, the same processing is performed.

In the case where the discharge processing is interrupted during the processing, e.g., the case where by a weight sensor, a specified time is passed after an operator is away from the medicine feeder, or the case where the feeder is stopped due to errors and the like, the display is returned to an initial screen and processing is continued only when the fingerprint recognition is performed again. Further, in the case where an operator wants to perform the processing later, operating a suspension button (not shown) allows suspension of the processing. In this case, as with the case of interruption, the processing is restarted only when the fingerprint recognition is performed again. It is to be noted that in the case of interruption, if an operator is the same person, the previously interrupted processing is forcedly restarted (the display returns to the interrupted screen).

When the inquiry operation button is operated, the display is switched to an inquiry operation menu screen shown in FIG. 31, where a prescription history inquiry button, a medicine administration search button, a medicine usage button, a medicine usage per doctor button, medicine usage per ward button, a medicine usage per controlled medicine button and an end button are displayed. By operating the prescription history inquiry button, a prescription history inquiry screen shown in FIG. 32 can be displayed and the prescription history can be inquired. By operating the medicine administration search button, a medicine administration search screen shown in FIG. 33 can be displayed and used for checking the inventory when inventory figures are questionable. By operating the medicine usage button, a medicine usage screen shown in FIG. 34 can be displayed and a list of medicine usage by administration date can be indicated. By operating the medicine usage per doctor button, a medicine usage per doctor screen shown in FIG. 36 can be displayed to confirm which doctors use which medicines and the quantity. By operating the medicine usage per ward button, a medicine usage per ward screen shown in FIG. 37 can be displayed to confirm usage of medicines per ward. By operating the medicine usage per controlled medicine button, the medicine usage per controlled medicine screen shown in FIG. 38 can be displayed to check the medicines required to be controlled such as psychotropic drugs by each medicine.

When the master maintenance button is operated, the display is switched to a master maintenance screen shown in FIG. 30, where a client master button, a medicine master button and the like are displayed. By operating the medicine master button, the display is switched to a medicine master screen shown in FIG. 40, where a list of medicine information can be displayed. In the screen, a reference inventory quantity refers to a maximum inventory capacity of medicines, and an appropriate inventory quantity refers to a minimum inventory quantity which requires replenishment.

By operating the replenishing operation button, the display is switched to a replenishing operation screen shown in FIG. 35, where a list of a replenishment quantity, a medicine quantity before replenishment, and a medicine quantity after replenishment per cassette 2 can be displayed.

By operating the daily report button, the display is switched to a daily report menu screen shown in FIG. 41, where a discharge daily report button and a daily report on replenishment button are displayed. By operating the replenishment daily report button, the display is switched to a replenishment daily report screen shown in FIG. 42, where a list of replenishment status of medicines can be displayed by inputting a desired data for the status output. This makes it possible to check replenishment errors and the like.

The invention claimed is:

1. A medicine feeder, comprising:

a cassette for housing medicine containers in a linear array;

a biasing member for biasing the linear array of medicine containers in the cassette toward one end side of the cassette; and a discharge member disposed on one end portion of the cassette so as to be rotatable between a reception position and an extraction position, wherein the discharge member includes: a holding recess portion for holding only one of the medicine containers biased by the biasing member upon rotation to the reception position and for maintaining a holding state of the held medicine container so that the medicine container can be extracted from outside upon rotation to the extraction position; and a support face formed on an opposite side relative to the holding recess portion so as to be able to support a next medicine container when the discharge member rotates to the extraction position.

2. The medicine feeder as defined in claim 1, further comprising: a medicine detection member for detecting whether or not a medicine is present in the holding recess portion when the discharge member is positioned at the extraction position; and a control device for allowing driving of the discharge member based on prescription data and a detection signal from the medicine detection member.

3. The medicine feeder as defined in claim 2, further comprising a lock member for disabling the discharge member from rotating, wherein the control device controls the lock member so as to lock the discharge member at the reception position when discharge of a prescribed quantity of medicines based on prescription data is completed.

4. The medicine feeder as defined in claim 1, wherein the discharge member has notches to facilitate holding of the medicine container, and the notches are located on opposite walls constituting the holding recess portion.

5. A medicine feeder, comprising:

a cassette for housing medicine containers arranged in a linear array;

a biasing member for biasing the medicine containers in the linear array in the cassette toward one end side of the cassette;

a discharge member disposed on one end portion of the cassette so as to be rotatable between a reception position and an extraction position; and a medicine quantity detection member for detecting a quantity of the medicines in the cassette;

wherein the medicine quantity detection member includes: a sensor for detecting a biased position by the biasing member in an initial state where medicines are not housed in the cassette; and an encoder for detecting a change in the position of the biasing member, caused by housing the medicines in the cassette, from the initial state detected by the sensor.

6. A medicine feeder, comprising:

a cassette for housing medicine containers arranged in a linear array;

a biasing member for biasing the medicine containers in the cassette toward one end side of the cassette while in the linear array; and a discharge member disposed on one end portion of the cassette for holding one of the medicine containers in a holding recess portion and discharging the medicine containers one by one through rotating movement of the discharge member, wherein the discharge member comprises a rotor, and an outer circumferential face of the rotor for supporting a next medicine container is formed so as not to change a position of the next medicine container due to the rotating movement.

7. A medicine feeder, comprising:

a cassette for housing medicine containers in a linear array;

a biasing member for biasing the medicine containers in the cassette toward one end side of the cassette while in the linear array;

a discharge member disposed on one end portion of the cassette for holding one of the medicine containers in a holding recess portion and discharging the medicine containers one by one through rotating movement of the discharge member, wherein the discharge member includes a rotor; and a control device for allowing driving of the rotor based on prescription data, wherein the control device is operable to automatically return the rotor to a standby position if a specified time has passed while the rotor is positioned at a discharge position.

8. A medicine feeder, comprising:

a cassette for housing medicine containers in a linear array;

a biasing member for biasing the medicine containers in the cassette toward one end side of the cassette while in the linear array; and a discharge member disposed on one end portion of the cassette for holding one of the medicine containers in a holding recess portion and discharging the medicine containers one by one through rotating movement of the discharge member, wherein the cassette is disposed so that housed medicine containers are arrayed in a horizontal direction so as to be discharged one by one in sequence from the one end side by the discharge member.

9. A medicine feeder, comprising:

a cassette for housing medicine containers in a linear array;

a biasing member for biasing the medicine containers in the cassette toward one end side of the cassette while in the linear array; and a discharge member disposed on one end portion of the cassette for holding one of the medicine containers in a holding recess portion and discharging the medicine containers one by one through rotating movement of the discharge member, wherein the cassette is disposed so that the housed medicine containers are arrayed in a vertical direction so as to be discharged one by one in sequence from an upper end of the cassette by the discharge member.

10. A medicine feeder, comprising:

a cassette for housing medicine vials in a linear array;

a biasing member for biasing the medicine vials in the cassette toward one end side of the cassette while in the linear array; and a discharge member disposed on one end portion of the cassette for holding one of the medicine vials in a holding recess portion and discharging the medicine vials one by one through rotating movement of the discharge member, wherein the cassette is disposed so that the medicine vials, each of which has an upper aperture closed by a lid, are housed in a state of being arrayed in a horizontal direction in a standing position.

11. A medicine feeder, comprising:

a cassette for housing medicine containers in a linear array;

a biasing member for biasing the medicine containers in the cassette toward one end side of the cassette while in the linear array; and a discharge member disposed on one end portion of the cassette for holding one of the medicine containers in a holding recess portion and discharging the medicine containers one by one through rotating movement of the discharge member, wherein the discharge member comprises a rotor, and the cassette is structured so as to be mounted on and dismounted from each housing portion of a stock shelf and the cassette has a lock member for preventing the rotor from rotating when the cassette is dismounted from the housing portion.

12. The medicine feeder as defined in claim 2, wherein the discharge member has notches to facilitate holding of the medicine, and the notches are located on opposite walls constituting the holding recess portion.

13. The medicine feeder as defined in claim 3, wherein the discharge member has notches to facilitate holding of the medicine, and the notches are located on opposite walls constituting the holding recess portion.

* * * * *